US007442262B2

(12) United States Patent
Sasaki

(10) Patent No.: US 7,442,262 B2
(45) Date of Patent: Oct. 28, 2008

(54) ALLOY FLAKE FOR RARE EARTH MAGNET, PRODUCTION METHOD THEREOF, ALLOY POWDER FOR RARE EARTH SINTERED MAGNET, RARE EARTH SINTERED MAGNET, ALLOY POWDER FOR BONDED MAGNET AND BONDED MAGNET

(75) Inventor: Shiro Sasaki, Hanno (JP)

(73) Assignee: Showa Denko K.K., Tokyo (JP)

( * ) Notice: Subject to any disclaimer, the term of this patent is extended or adjusted under 35 U.S.C. 154(b) by 501 days.

(21) Appl. No.: 10/498,932

(22) PCT Filed: Dec. 18, 2002

(86) PCT No.: PCT/JP02/13231

§ 371 (c)(1),
(2), (4) Date: Jun. 16, 2004

(87) PCT Pub. No.: WO03/052778

PCT Pub. Date: Jun. 26, 2003

(65) Prior Publication Data

US 2005/0028892 A1 Feb. 10, 2005

Related U.S. Application Data

(60) Provisional application No. 60/430,649, filed on Dec. 4, 2002, provisional application No. 60/410,802, filed on Sep. 16, 2002, provisional application No. 60/343,192, filed on Dec. 31, 2001, provisional application No. 60/343,187, filed on Dec. 31, 2001.

(30) Foreign Application Priority Data

| | | |
|---|---|---|
| Dec. 18, 2001 | (JP) | 2001-383989 |
| Dec. 19, 2001 | (JP) | 2001-385544 |
| Jul. 15, 2002 | (JP) | 2002-205214 |
| Nov. 22, 2002 | (JP) | 2002-339189 |

(51) Int. Cl.

| | |
|---|---|
| *H01F 1/057* | (2006.01) |
| *B22D 13/00* | (2006.01) |
| *B22D 11/00* | (2006.01) |

(52) U.S. Cl. ..... 148/302; 148/101; 148/539; 164/463; 164/114

(58) Field of Classification Search ..... None
See application file for complete search history.

(56) References Cited

U.S. PATENT DOCUMENTS 5,431,747 A 7/1995 Takebuchi et al.

(Continued)

FOREIGN PATENT DOCUMENTS

CN 1166677 A 12/1997

(Continued)

OTHER PUBLICATIONS

Kusunoki et al., "Highly Energy Product of Nd-Fe-B Magnet Sintered with Rare Earth Intemetallic Compounds," *T. IEEE Japan 113-A*(12):849-853 (1993).

(Continued)

*Primary Examiner*—John P. Sheehan
(74) *Attorney, Agent, or Firm*—Sughrue Mion, PLLC

(57) ABSTRACT

Disclosed is a rare earth magnet in the R-T-B (rare earth element-transition metal-boron) system that is made from an improved composition and properties of main phase alloy in the R-T-B system containing Pr and a boundary alloy. Disclosed also is a manufacturing method of the rare earth magnet alloy flake by a strip casting method with improved rotating rollers such that the alloy flake has a specified fine surface roughness and has a small and regulated amount of fine R-rich phase regions. Consequently, the alloy flake for the rare earth magnet does not containing α-Fe and has a homogeneous morphology so that the rare earth magnet formed by sintering or bonding the alloy flakes exhibits excellent magnetic properties.

11 Claims, 6 Drawing Sheets

U.S. PATENT DOCUMENTS

| | | | | |
|---|---|---|---|---|
| 5,486,239 | A | 1/1996 | Nakayama et al. | |
| 5,908,513 | A | 6/1999 | Sasaki et al. | |
| 5,948,179 | A * | 9/1999 | Hasegawa et al. | 148/301 |
| 5,963,774 | A | 10/1999 | Sasaki et al. | |
| 6,045,629 | A | 4/2000 | Hasegawa et al. | |
| 6,419,723 | B2 | 7/2002 | Hirota et al. | |
| 6,796,363 | B2 | 9/2004 | Arai et al. | |
| 7,014,718 | B2 * | 3/2006 | Hasegawa et al. | 148/302 |
| 2002/0020472 | A1 | 2/2002 | Arai et al. | |
| 2002/0020514 | A1 | 2/2002 | Arai et al. | |
| 2002/0117235 | A1 * | 8/2002 | Kanekiyo et al. | 148/101 |
| 2004/0020569 | A1 * | 2/2004 | Kanekiyo et al. | 148/302 |
| 2005/0011588 | A1 | 1/2005 | Hasegawa et al. | |
| 2005/0028892 | A1 | 2/2005 | Sasaki | |
| 2005/0098238 | A1 * | 5/2005 | Morimoto et al. | 148/302 |

FOREIGN PATENT DOCUMENTS

| | | | |
|---|---|---|---|
| CN | 1326830 | A | 12/2001 |
| CN | 1329954 | A | 1/2002 |
| EP | 0595477 | A1 | 5/1994 |
| EP | 0237416 | A1 | 9/1997 |
| EP | 0801402 | A1 | 10/1997 |
| EP | 0886284 | A1 | 12/1998 |
| EP | 1 146 524 | A1 | 10/2001 |
| JP | 60-072648 | A | 4/1985 |
| JP | 62-206802 | A | 9/1987 |
| JP | 04-028457 | A | 1/1992 |
| JP | 05-222488 | A | 8/1993 |
| JP | 5-295490 | A | 11/1993 |
| JP | 6-151132 | A | 5/1994 |
| JP | 07-068351 | A | 3/1995 |
| JP | 08-150442 | A | 6/1996 |
| JP | 08-269643 | A | 10/1996 |
| JP | 09-001296 | A | 1/1997 |
| JP | 9-31609 | A | 2/1997 |
| JP | 09-045522 | A | 2/1997 |
| JP | 09-170055 | A | 6/1997 |
| JP | 9-271909 | A | 10/1997 |
| JP | 10-36949 | A | 2/1998 |
| JP | 2817624 | B2 | 8/1998 |
| JP | 10-317110 | A | 12/1998 |
| JP | 2001-59144 | A | 3/2001 |
| JP | 2001-244107 | A | 9/2001 |
| JP | 3234741 | B2 | 9/2001 |
| JP | 2001-358004 | A | 12/2001 |
| JP | 2002-059245 | A | 2/2002 |
| JP | 2002-59246 | A | 2/2002 |
| JP | 2003-188006 | A | 7/2003 |

OTHER PUBLICATIONS

Itou et al., "Effects of Dry Compound Powder Addition on the Microstructures and the Magnetic Properties of Nd-Fe-B Sintered Magnets," *J. Japan Inst. Metals 59*(1):103-107 (1995).

Takeshita et al., "Magnetic Properties and Microstructures of the NdFeB Magnet Powder Produced by Hydrogen Treatment," *Proc. 10th Int. Workshop on RE Magnets and their Application 1*:551 (1989), Kyoto.

* cited by examiner

LEFT: MOLD SURFACE, RIGHT: FREE SURFACE

LEFT: MOLD SURFACE, RIGHT: FREE SURFACE

INSIDE OF THE DOTTED LINE CONTAINS α-Fe 0.5mm FORM MOLD SURFACE

CENTER 0.5mm FORM FREE SURFACE

ALLOY FLAKE FOR RARE EARTH MAGNET, PRODUCTION METHOD THEREOF, ALLOY POWDER FOR RARE EARTH SINTERED MAGNET, RARE EARTH SINTERED MAGNET, ALLOY POWDER FOR BONDED MAGNET AND BONDED MAGNET

CROSS-REFERENCE TO RELATED APPLICATION

This application claims the benefit pursuant to 35 U.S.C. §119(e)(1) of U.S. Provisional Applications, No. 60/343,187 filed on Dec. 31, 2001, U.S. Provisional Application No. 60/343,192 filed on Dec. 31, 2001, U.S. Provisional application No. 60/410,802 filed on Sep. 16, 2002, and a U.S. Provisional Application No. 60/430,649 filed on Dec. 4, 2002.

TECHNICAL FIELD

The present invention relates to a main phase alloy containing Pr and a boundary phase alloy for producing a rare earth magnet, to a method for producing the alloy, to a mixed powder for a rare earth sintered magnet, for a rare earth magnet; and to a rare earth magnet. The present invention also relates to rare earth magnet alloy flake, formed of an R-T-B alloy (R represents at least one rare earth element including Y; T represents transition metals including Fe as an essential element; and B represents boron); a method for producing the flake; to a rare earth sintered magnet alloy powder, a rare earth sintered magnet, a bonded magnet alloy powder and a bonded magnet, and more particularly, relates to a rare-earth-containing alloy flake produced through the strip casting method and to a method for producing the alloy flake.

BACKGROUND ART

In recent years, production of Nd—Fe—B alloys serving as magnet alloys has sharply increased by virtue of excellent characteristics of the alloys, and these alloys are employed in HDs (hard disks), MRI (magnetic resonance imaging), a variety of motors, etc. Typically, Nd is partially substituted by another rare earth element such as Pr or Dy and Fe is partially substituted by another transition metal element such as Co or Ni. Such substituted alloys as well as Nd—Fe—B alloys are generally referred to as R-T-B alloys. Herein, R represents at least one rare earth element including Y, and T represents transition metals including Fe as an essential element. Fe may be partially substituted by Co or Ni. Other elements such as Cu, Al, Ti, V, Cr, Mn, Nb, Ta, Mo, W, Ca, Sn, Zr, and Hf may be added, to the R-T-B alloys, singly or in combination of two or more species. B represents boron and B may be partially substituted by C or N.

An R-T-B alloy contains, as the main phase, a ferromagnetic phase formed of $R_2T_{14}B$ crystals, which contribute to magnetization, and a nonmagnetic R-rich phase having a low melting point and containing a rare earth element(s) at high concentration. Since the R-T-B alloy is an active metallic material, the alloy is generally melted and mold-cast in vacuum or under inert gas. In a typical method of producing a sintered magnet, an ingot of the alloy is pulverized to powder having a particle size of about 3 μm (as measured by means of FSSS (Fisher Sub-Sieve Sizer)); the powder is subjected to press-forming in a magnetic field; the resultant compact is sintered in a sintering furnace at a temperature as high as approximately 1,000 to 1,100° C.; and in accordance with needs, the sintered product is heated, mechanically processed, and plated for corrosion prevention.

The R-rich phase plays the following important roles in sintered magnets formed of the R-T-B alloy.

(1) Since the R-rich phase has a low melting point, the phase liquefies during sintering, thereby contributing to achievement of high density of the resultant magnet, leading to improved magnetization.

(2) The R-rich phase functions to smoothen grain boundaries, thereby reducing the number of nucleation sites of reversed magnetic domains, thereby enhancing the coercivity.

(3) The R-rich phase magnetically insulates the main phase, thereby enhancing the coercivity.

The distribution of the R-rich phase in a magnet, the final product, depends greatly on the microstructure of the as-cast alloy ingot. Specifically, when the alloy ingot is produced through mold casting, a slow cooling rate of the cast ingot often results in formation of large crystal grains in the $R_2T_{14}B$ phase, and R-rich phase forms large aggregates which are locally present in the ingot. Thus, the particle size of the pulverized alloy ingot becomes considerably smaller than the grain size of crystals present in the $R_2T_{14}B$ phase or than the size of dispersed R-rich phase. Therefore, particles formed only of the main phase ($R_2T_{14}B$ phase) containing no R-rich phase and particles formed only of the R-rich phase are produced, whereby homogeneously mixing the main phase and R-rich phase becomes difficult.

Another problem involved in mold casting is that γ-Fe tends to be formed as primary crystals, due to the slow cooling rate. At approximately 910° C. or lower, γ-Fe transforms into α-Fe, which deteriorates pulverization efficiency during production of sintered magnets. If α-Fe remains even after sintering, magnetic characteristics of the sintered product are deteriorated. Thus, the ingot obtained through mold casting must be subjected to homogenization treatment at high temperature for a long period of time in order to remove α-Fe.

In order to solve the above problems; i.e., segregation of R-rich phase and precipitation of α-Fe, the strip casting method (abbreviated as SC method) and the centrifugal casting method (abbreviated as CC method), which ensure a cooling rate during casting of R-T-B alloy that is faster than that attainable by mold casting, are proposed and employed in actual production steps.

In the SC method, molten alloy is poured onto a rotatable copper roller for casting, the inside of which is cooled by water, and is formed into a strip having a thickness of about 0.1 to about 1 mm. During casting, the molten alloy is solidified through rapid cooling, to thereby prevent precipitation of α-Fe which is formed during mold casting and yield an alloy having a microcrystalline structure in which R-rich phase is minutely dispersed. Since the R-rich phase is minutely dispersed in the alloy ingot produced through the SC method, dispersion of R-rich phase in the product obtained by pulverizing and sintering the alloy also becomes satisfactory, to thereby successfully produce magnets of improved magnetic characteristics (Japanese Patent Application Laid-Open (kokai) Nos. 5-222488 and 5-295490).

Meanwhile, the CC method includes feeding a molten metal into the interior of a cylindrical mold which is rotating, to thereby simultaneously deposit and solidify the molten metal. Thus, the method attains an intermediate solidification rate between that attainable by mold casting and that attainable by the SC method (U.S. Pat. No. 2,817,624). This particular solidification condition is confirmed to be effective for producing a boundary phase alloy for employment in the two-alloy blending method (U.S. Pat. No. 3,234,741).

As compared with the mold casting method, the SC method and CC method attain high uniformity in microstructure. The uniformity in microstructure can be evaluated in terms of crystal grain size and dispersion state of R-rich phase as well as presence of precipitated α-Fe. When an alloy is cast through the mold casting method, a portion of the resultant alloy ingot which has remained in the vicinity of the mold and has been rapidly cooled exhibits a microstructure formed of minute equiaxed crystal grains called chill crystals and contains a comparatively finely dispersed R-rich phase. However, in the center portion of the alloy ingot where solidification is finally complete, crystal grains have a large grain size and R-rich phase forms aggregates in some regions, because of a considerably slow solidification rate in the center portion.

In the alloy flakes produced through the SC method, chill crystals may be formed on the side which has been in contact with a rotating roller for casting (hereinafter referred to as a mold side). However, an appropriately minute and uniform microstructure can be generally obtained through rapid-cooling solidification. In addition, since formation of α-Fe is suppressed, uniformity in R-rich phase contained in a sintered magnet, a final product, is enhanced, thereby preventing impairment of α-Fe in terms of pulverizability and magnetic characteristics.

When a molten alloy is cast through the CC method, the molten alloy is gradually deposited and the thus-solidified thin layers are stacked. Therefore, the cast product can possess a microstructure which is almost uniform from the mold side to the free surface side, despite its large thickness, except that chill crystals are formed in a mold side portion. However, since a conventional CC method (e.g., a method disclosed in U.S. Pat. No. 2,817,624) employs a comparatively high rate of feeding molten alloy, the substantial solidification rate becomes slower than that employed in the SC method. Thus, the conventional CC method attains an effect for preventing precipitation of α-Fe to a degree, which lies between that attainable by mold casting and that attainable by the SC method.

In recent years, Nd in R-T-B alloys for producing rare earth magnets has often been partially substituted by Pr. This is because partial substitution of Nd by Pr causes only a small variation in characteristics; Pr is less expensive than Nd; and production cost can be reduced. In the case of an $R_2Fe_{14}B$ compound, saturation magnetization at room temperature of the compound (R=Nd) is known to be approximately 4% higher than that of the compound (R=Pr), but anisotropic magnetic field of the compound (R=Pr) is known to be approximately 5% higher than that of the compound (R=Nd). Regardless of whether R is Nd or Pr, phase conditions around $R_2Fe_{14}B$ compound are substantially the same. Thus, even when Nd of $R_2Fe_{14}B$ is partially substituted by Pr, phase constitutions remain substantially unchanged, and magnetism is not deteriorated by such a subtle change in microstructure.

The present invention is constituted by four aspects and respective aspects have following problems to be solved.

The problems to be solved by the first aspect of the present invention is described below.

From the viewpoint of cost reduction and effective utilization of resources, substitution in terms of R in R-T-B alloys for producing rare earth magnets, i.e., partial substitution of Nd by Pr, has been widely employed. However, the Pr content of R can be elevated up to about 10% by mass, because Pr is chemically active as compared with Nd. Such high chemical activity causes problematic oxidation during production of magnets or in the produced magnets.

As compared with the single-alloy method, the two-alloy blending method, which is widely employed for producing high-performance magnets, imposes more severe limitation on the amount of Pr added. The two-alloy blending method employs two types of raw material alloys; i.e., a main phase alloy, which predominantly provides $R_2Fe_{14}B$ phase (main phase) and has a composition similar to that of $R_2Fe_{14}B$, and a boundary phase alloy, which predominantly provides R-rich phase (grain boundary phase) and has a TRE (Total Rare Earth content) greater than that of the main phase alloy.

In the two-alloy blending method, Pr is preferably added to the main phase alloy. When Pr is added to the boundary phase alloy containing a large amount of R-rich phase, which per se is prone to oxidation, activity is further increased. Thus, oxidation occurs predominantly during pulverization involved in magnet production steps and in the resultant micro-powder, leading to requirement of strong countermeasures for preventing oxidation, or deterioration in magnet characteristics caused by an increase in oxygen content thereof. Such countermeasures render the steps and apparatus for producing magnets complex, resulting in increased cost. In contrast, when Pr is added to the main phase alloy, Pr is predominantly incorporated into $R_2Fe_{14}B$ phase, which per se is highly anti-corrosive, so that problematic oxidation can be mitigated. In addition, when Nd is partially substituted by Pr, an anisotropic magnetic field of $R_2Fe_{14}B$ phase slightly increases. Thus, the micro-powder can be readily caused to be oriented during orientation in a magnetic field, thereby increasing magnetization and a degree of orientation of produced magnets.

As mentioned above, Pr is preferably added to the main phase alloy. However, in the course of partial substitution of Nd of the main phase alloy having a low TRE by Pr, α-Fe is prone to precipitate. One possible reason is that the substitution by Pr increases the difference between a temperature of the liquidus at which formation of γ-Fe (high-temperature phase) is initiated and the peritectic temperature at which formation of $R_2Fe_4B$ phase is initiated. Since α-Fe is difficult to pulverize, efficiency of pulverization in magnet production steps is deteriorated, thereby reducing productivity of magnets. If unpulverized α-Fe remains in a pulverization apparatus, the composition of the resultant micro-powder varies. If α-Fe remains in a magnet even after sintering, magnetic characteristics of the magnet are considerably deteriorated.

According to the SC method, molten metal can be supercooled at high cooling rate to a temperature lower than peritectic temperature at which $R_2Fe_{14}B$ phase is formed, thereby preventing precipitation of α-Fe. However, when an Nd—Fe—B ternary main phase alloy has an Nd content of about 28.5% by mass or less, sufficient supercooling cannot be attained, whereby α-Fe is formed. In addition, when Nd is partially substituted by Pr, precipitation of α-Fe is further promoted. Thus, in order to prevent precipitation of α-Fe, the TRE of the main phase alloy must be increased. In the two-alloy blending method, the TRE of the main phase alloy is preferably adjusted to as low a level as possible so as to enhance the mixing ratio of the boundary phase alloy.

An increase in B content is known to be remarkably effective for preventing precipitation of α-Fe. However, when the B content of the main phase alloy increases, the B content of the boundary phase alloy must be lowered in order to adjust the total B level of the finally produced magnet. Addition of Co or a heavy rare earth element to the main phase alloy is also effective for preventing precipitation of α-Fe. However, when the above compositional control approaches are employed, the degree of freedom in compositional design for magnet alloy decreases. Even when the two-alloy blending method is employed, an optimum combination of the compositions is difficult to attain.

The element Co, which exerts excellent effect for improving corrosion resistance, is preferably added to the boundary phase alloy (Kusunoki et al., T. IEEE Japan, Vol. 113-A, No. 12, 1993, 849-853). A heavy rare earth element is also confirmed to exert excellent effect for enhancing coercivity when the element is added to the boundary phase alloy (Ito et al., Journal of the Japan Institute of the Metals, Vol. 59, No. 1 (1995), 103-107).

The problems of the second aspect of the present invention are as follows.

A series of studies were carried out on the relationship between the microstructure of the cast R-T-B alloy ingot and the behavior upon hydrogen decrepitation or micro-pulverization, and has found that control of the dispersion state of R-rich phase is more critical, for providing a sintered magnet alloy powder of uniform particle size, than control of the crystal grain size of the alloy ingot. The inventor has also found that a region in which dispersion state of R-rich phase is excessively minute (fine R-rich phase region) formed on the mold side of the alloy ingot is a more critical factor for controlling the particle size of magnet powder than adverse effects of chill crystals, which are in fact contained in an alloy ingot in amounts of some % or less. In other words, the inventor has confirmed that the percent volume of fine R-rich phase region may be in excess of 50% even when the number of chill crystals contained in the R-T-B alloy ingot is decreased through modification of the composition of the alloy ingot or production conditions; that the fine R-rich phase region deforms the particle size distribution of the magnet alloy powder; and that the fine R-rich phase region must be reduced in order to enhance magnet characteristics.

The problems to be solved by third aspect is described below.

Through the method disclosed in Japanese Patent Application No. 2001-383989, reduction of fine R-rich phase region and yielding of uniform microstructure can be attained to some extent. However, other than surface conditions of a roller for casting, there are a variety of factors which determine the microstructure, and such factors are difficult to completely control during actual R-T-B alloy production. Thus, fine R-rich phase region may be formed at a portion of the alloy.

The problems to be solved by the fourth aspect are as follows.

The present inventor has carried out extensive studies on the relationship between the microstructure of the cast R-T-B alloy ingot and the behavior upon hydrogen decrepitation or micro-pulverization, and has found that control of the dispersion state of R-rich phase is more critical, for providing a sintered magnet alloy powder of uniform particle size, than control of the crystal grain size of the alloy ingot. The inventor has also found that a region in which dispersion state of R-rich phase is excessively minute (fine R-rich phase region) formed on the mold side of the alloy ingot is a more critical factor for controlling the particle size of magnet powder than adverse effects of chill crystals, which are in fact contained in an alloy ingot in amounts of some % or less. In other words, the inventor has confirmed that the percent volume of fine R-rich phase region may be in excess of 50% even when the number of chill crystals contained in the R-T-B alloy ingot is decreased through modification of the composition of the alloy ingot or production conditions; that the fine R-rich phase region deforms the particle size distribution of the magnet alloy powder; and that the fine R-rich phase region must be reduced in order to enhance magnet characteristics.

The present invention has been accomplished on the basis of this finding and an object thereof is to provide a method for producing an rare-earth-containing alloy flake, the method more effectively preventing formation of fine R-rich phase region in a cast rare-earth-containing alloy ingot made of an R-T-B alloy, and a rare-earth-containing alloy flake having a structure with excellent uniformity produced by the above method.

DISCLOSURE OF THE INVENTION

In view of the foregoing, an object of the first aspect of the present invention is to provide a main phase alloy for a rare earth magnet, the alloy being formed of an R-T-B alloy and to be subjected to the two-alloy blending method, wherein anisotropic magnetic field is enhanced and the amount of α-Fe formed is lowered at advantageously low cost by partially substituting Nd by Pr without increasing the TRE of the main phase alloy for preventing precipitation of α-Fe and without performing compositional control through addition of elements such as B and Co.

Accordingly, the first aspect of the present invention is directed to the following:

(1) a main phase alloy for a rare earth magnet to be processed through the two-alloy blending method, the alloy containing R(R represents at least one rare earth element including Y) in an amount of 26 to 30% by mass and B in an amount of 0.9 to 1.1% by mass, with the balance being T (T represents transition metals including Fe as an essential element), characterized in that R has a Pr content of at least 5% by mass and the main phase alloy has a percent volume of region containing α-Fe on the basis of the entire microstructure of 5% or less;

(2) a main phase alloy for a rare earth magnet as described in (1), wherein R has a Pr content of at least 15% by mass;

(3) a main phase alloy for a rare earth magnet as described in (2), wherein R has a Pr content of at least 30% by mass;

(4) a main phase alloy for a rare earth magnet as described in any one of (1) to (3), wherein at least one surface thereof has a surface roughness, as represented by 10-point average roughness (Rz), falling within a range of 5 μm to 50 μm;

(5) a main phase alloy for a rare earth magnet as described in (4), wherein at least one surface thereof has a surface roughness, as represented by 10-point average roughness (Rz), falling within a range of 7 μm to 25 μm;

(6) a method for producing a main phase alloy for a rare earth magnet as recited in any one of (1) to (5), wherein the method comprises strip casting;

(7) a method for producing a main phase alloy for a rare earth magnet as described in (6), wherein the surface roughness, as represented by 10-point average roughness (Rz), of the cast surface of a rotating roller for casting is adjusted to fall within a range of 5 μm to 100 μm;

(8) a method for producing a main phase alloy for a rare earth magnet as described in (6), wherein the surface roughness, as represented by 10-point average roughness (Rz), of the cast surface of a rotating roller for casting is adjusted to fall within a range of 10 μm to 50 μm;

(9) a method for producing a main phase alloy for a rare earth magnet as described in any one of (1) to (3), characterized by comprising a centrifugal casting method including depositing and solidifying a molten metal on an inner surface of a cylindrical mold which is rotating;

(10) a mixed powder for a rare earth sintered magnet produced by mixing a main phase alloy for a rare earth magnet as recited in any one of (1) to (3) with a boundary phase alloy which has an R content higher than that of the main phase alloy and has a Pr content of R lower than that of the main phase alloy;

(11) a mixed powder for a rare earth sintered magnet as described in (10), wherein the boundary phase alloy contains substantially no Pr; and

(12) a rare earth sintered magnet produced through a powder metallurgical method making use of a mixed powder for a rare earth magnet as described in (10) or (11).

An object of the second aspect of the present invention is to provide a rare earth magnet in which R-rich phase is uniformly dispersed and which exhibits excellent magnet characteristics by suppressing formation of fine R-rich phase region contained in the cast R-T-B alloy ingot, to thereby produce an alloy ingot having a microstructure of high uniformity.

Comparisons were made in terms of percent volume of fine R-rich phase region formed in an R-T-B alloy flake under modification of casting conditions of the SC method, particularly surface conditions of a rotating roller for casting, and has found a relationship between the surface roughness of the mold side surface of the alloy flake and the percent volume of the formed fine R-rich phase region. The present invention has been accomplished on the basis of this finding.

Accordingly, the second aspect of the present invention provides the following:

(13) a rare earth magnet alloy flake comprising an R-T-B alloy (R represents at least one rare earth element including Y; T represents transition metals including Fe as an essential element; and B represents boron), characterized in that the flake has a thickness falling within a range of 0.1 mm to 0.5 mm, and that at least one surface of the flake has a surface roughness, as represented by 10-point average roughness (Rz), falling within a range of 5 μm to 50 μm;

(14) a rare earth magnet alloy flake as described in (13), wherein at least one surface of the alloy flake has a surface roughness, as represented by 10-point average roughness (Rz), falling within a range of 7 μm to 25 μm;

(15) a rare earth magnet alloy flake as described in (13) or (14), wherein the flake has a percent volume of fine R-rich phase region in alloy that constitutes the alloy flake of 20% or less;

(16) a method for producing a rare earth magnet alloy flake formed of an R-T-B alloy including a strip casting method, characterized by comprising adjusting the surface roughness, as represented by 10-point average roughness (Rz), of the cast surface of a rotating roller for casting to fall within a range of 5 μm to 100 μm;

(17) a method for producing a rare earth magnet alloy flake as recited in any one of (13) to (15) formed of an R-T-B alloy including a strip casting method, characterized by comprising adjusting the surface roughness, as represented by 10-point average roughness (Rz), of the cast surface of a rotating roller to fall within a range of 5 μm to 100 μm;

(18) a method for producing a rare earth magnet alloy flake as described in (16) or (17), wherein the surface roughness, as represented by 10-point average roughness (Rz), of the cast surface of the rotating roller for casting is adjusted to fall within a range of 10 μm to 50 μm;

(19) a rare earth sintered magnet alloy powder produced by subjecting, to a hydrogen descepitation step, a rare earth magnet alloy flake as recited in any one of (13) to (15), followed by pulverization by means of jet milling;

(20) a rare earth sintered magnet produced from a rare earth magnet alloy powder as recited in (19) through a powder metallurgy method;

(21) A bonded magnet alloy powder produced by use of a rare earth magnet alloy flake as recited in any one of (13) to (15) through an HDDR method; and

(22) A bonded magnet produced by use of a bonded magnet alloy powder as recited in (21).

An object of the third aspect of the present invention is to provide a method for producing an alloy ingot having a microstructure of high uniformity, the method more effectively preventing formation of fine R-rich phase region in the cast R-T-B alloy ingot as compared with conventional methods. Another object of the invention is to provide a rare earth magnet of excellent magnet characteristics which are attained by further increasing uniformity in the R-rich phase distribution state in the magnet.

The object of the third aspect of the present invention is as follows.

The present inventor has performed comparison in terms of percent volume of fine R-rich phase region formed in an R-T-B alloy flake under modification of surface conditions of a rotating roller for casting employed in the SC method, and has found that the percent volume of the formed fine R-rich phase region depends on the morphology of raised/dented segments provided on the mold side surface of the alloy flake, as well as on the surface roughness of the mold side surface of the alloy flake. The present invention has been accomplished on the basis of this finding.

Accordingly, the third aspect of the present invention provides the following:

(23) a rare-earth-containing alloy flake, characterized in that the alloy flake has a thickness falling within a range of 0.1 mm to 0.5 mm; at least one surface of the alloy flake has a plurality of elongated raised/dented segments (i.e., small ridge/valley areas) formed so as to cross one another; and the surface having the elongated raised/dented segments has a surface roughness, as represented by 10-point average roughness (Rz), falling within a range of 3 μm to 30 μm;

(24) a rare-earth-containing alloy flake as described in (23), wherein the alloy flake comprises an R-T-B alloy (R represents at least one rare earth element including Y; T represents transition metals including Fe as an essential element; and B represents boron) which serves as a raw material for producing a rare earth magnet;

(25) a rare-earth-containing alloy flake as described in (24), wherein the flake has a percent volume of fine R-rich phase region in alloy that constitutes the alloy flake of 20% or less;

(26) a method for producing a rare-earth-containing alloy flake including a strip casting (SC) method, characterized by comprising employing a rotating roller for casting, the roller having, on the cast surface, a plurality of elongated raised/dented segments formed so as to cross one another and having a surface roughness of the cast surface, as represented by 10-point average roughness (Rz), falling within a range of 3 μm to 30 μm;

(27) a method for producing a rare-earth-containing alloy flake as described in (26), wherein the alloy flake has a thickness falling within a range of 0.1 mm to 0.5 mm; at least one surface of the alloy flake has a plurality of elongated raised/dented segments formed so as to cross one another; and the surface having the elongated raised/dented segments has a surface roughness, as represented by 10-point average roughness (Rz), falling within a range of 3 μm to 30 μm;

(28) a method for producing a rare-earth-containing alloy flake as described in (26) or (27), wherein the rare-earth-containing alloy flake comprises an R-T-B alloy (R represents at least one rare earth element including Y; T represents transition metals including Fe as an essential element; and B represents boron) which serves as a raw material for producing a rare earth magnet;

(29) a method for producing a rare-earth-containing alloy flake as described in (28), wherein the flake has a percent volume of fine R-rich phase region in alloy that constitutes the alloy flake of 20% or less;

(30) an alloy powder for a rare earth sintered magnet produced by subjecting, to a hydrogen decrepitation step, a rare-earth-containing alloy flake as recited in (24) or (25), followed by pulverization by means of a jet mill;

(31) a rare earth sintered magnet produced from an alloy powder for a rare earth sintered magnet as recited in (30) through a powder metallurgy method;

(32) an alloy powder for a bonded magnet produced by use of a rare-earth-containing alloy flake as recited in (24) or (25) through an HDDR method; and

(33) a bonded magnet produced by use of an alloy powder for a bonded magnet as recited in (32).

The object of the fourth aspect of the present invention is summarized as follows.

The present inventor has previously carried out extensive studies on the relationship between the microstructure of the cast R-T-B alloy ingot and the behavior upon hydrogen decrepitation or micro-pulverization, and has found that control of the dispersion state of R-rich phase is more critical, for providing a sintered magnet alloy powder of uniform particle size, than control of the crystal grain size of the alloy ingot. The present inventor has performed comparison in terms of percent volume of fine R-rich phase region formed in an R-T-B alloy flake under modification of casting conditions of the SC method, particularly surface conditions of a rotating roller for casting, and has found a relationship between the surface roughness of the mold side surface of the alloy flake and the percent volume of the formed fine R-rich phase region. The present inventor has accomplished a method for producing alloy flakes having a microstructure of high uniformity and a percentage of fine R-rich phase region of 20% or less.

Also the present inventor has found that uniformity of the structure can be improved more effectively by providing a plurality of elongated raised/dented segments constituting surface roughness of a rotating roller for casting so as to cross one another.

That is, the present inventor has found that reduction in fine R-rich phase region and improvement in uniformity of the structure can be achieved by the above method and that uniformity of the structure can be improved more effectively by controlling not only the surface roughness expressed by a numerical value of the rotating roller, but also the morphology of raised/dented segments as an origin of the surface roughness.

The present invention has been accomplished on the basis of the finding obtained by previous studies and the following extensive studies and an object thereof is to provide a method for producing an rare-earth-containing alloy flake, the method more effectively preventing formation of fine R-rich phase region in a cast rare-earth-containing alloy ingot made of an R-T-B alloy by further improving the morphology of raised/dented segments on the rotating roller for casting, and a rare earth sintered magnet of excellent magnet characteristics which are attained by further increasing uniformity in the R-rich phase distribution state in the magnet.

Accordingly, the fourth aspect of the present invention provides the following:

(34) a method for producing a rare-earth-containing alloy flake including a strip casting method, characterized by comprising employing a rotating roller for casting, the roller having, on the cast surface, a plurality of elongated raised/dented segments and having a surface roughness provided by a plurality of elongated raised/dented segments, as represented by 10-point average roughness (Rz), falling within a range of 3 μm to 60 μm, 30% or more of raised/dented segments among entire elongated raised/dented segments extending in a direction forming an angle of 30° or more to a roller rotation direction;

(35) a method for producing a rare-earth-containing alloy flake as described in (34), characterized by comprising employing a rotating roller for casting, 30% or more of raised/dented segments among entire elongated raised/dented segments extending in a direction forming an angle of 45° or more to a roller rotation direction;

(36) a method for producing a rare-earth-containing alloy flake as described in (34), characterized by comprising employing a rotating roller for casting, 50% or more of raised/dented segments among entire elongated raised/dented segments extending in a direction forming an angle of 30° or more to a roller rotation direction;

(37) a method for producing a rare-earth-containing alloy flake as described in any one of (34) to (36), characterized by comprising employing a rotating roller for casting, 50% or more of raised/dented segments among entire elongated raised/dented segments extending in a direction forming an angle of 45° or more to a roller rotation direction;

(38) a method for producing a rare-earth-containing alloy flake as described in any one of (34) to (37), wherein the rare-earth-containing alloy flake comprising an R-T-B alloy (R represents at least one rare earth element including Y; T represents transition metals including Fe as an essential element; and B represents boron) which serves as a raw material for producing a rare earth magnet in the production of the rare-earth-containing alloy flake by the strip casting method;

(39) an alloy flake for rare earth magnet produced by the method as recited in (38), which has a percent volume of fine R-rich phase region in alloy that constitutes the alloy flake of 20% or less;

(40) a powder for a rare earth sintered magnet produced by subjecting, to a hydrogen decrepitation step, an alloy flake for rare earth magnet produced by the method as recited in (38), followed by pulverization by means of a jet mill;

(41) a rare earth sintered magnet produced from an alloy powder for a rare earth sintered magnet as recited in (7) through a powder metallurgy method;

(42) an alloy powder for a bonded magnet produced by use of an alloy flake for rare earth magnet produced by the method as recited in (38) through an HDDR method; and

(43) a bonded magnet produced by use of an alloy powder for a bonded magnet as recited in (42).

BEST MODE FOR CARRYING OUT THE INVENTION

Figure 1:
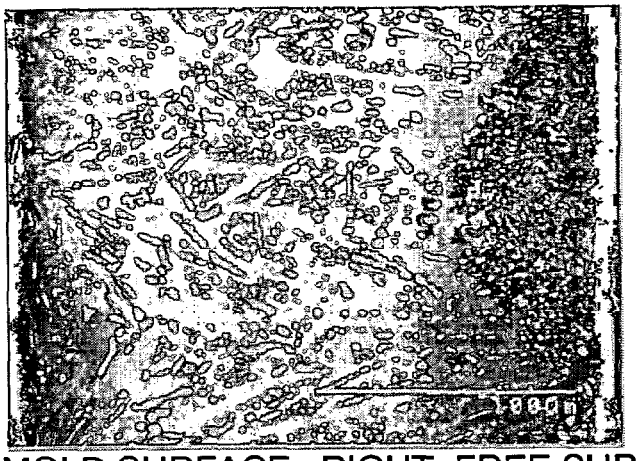
FIG. 1 is a photograph showing a cross section of an alloy flake for a rare earth magnet produced through a conventional SC method.

Hereinafter, the present invention is described in the order from the first aspect to the fourth aspect.

First Aspect

As described above, when a rare earth magnet formed of R-T-B alloy is produced through the two-alloy blending method, Pr is preferably added to the main phase alloy for incorporating Pr into R. However, when Nd is partially substituted by Pr, precipitation of α-Fe is promoted. Therefore, in conventional techniques, another element must be added to the main phase alloy, or the composition of the main phase alloy must be modified. The above compositional control approaches greatly limit the degree of freedom in designing of alloy, which is a merit of the two-alloy blending method. Thus, effective use of Pr in production of rare earth magnets through the two-alloy blending method cannot be fully attained.

The present inventor has found that precipitation of α-Fe can be greatly suppressed by modifying casting conditions for casting a main phase alloy for a rare earth magnet through the SC method, particularly by modifying surface conditions of a rotating roller for casting, thereby improving heat transfer from molten alloy to the roller. Thus, the inventor has successfully attained, in the two-alloy blending method, substitution of a large number of Nd atoms contained in a low-TRE main phase alloy by Pr.

The present inventor has confirmed that precipitation of α-Fe in a main phase alloy for a rare earth magnet produced through a centrifugal casting method including depositing and solidifying a molten metal on an inner surface of a cylindrical mold which is rotating is more effectively inhibited, as compared with a conventional SC method, by means of lowering the deposition rate. The inventor has successfully produced, through the centrifugal casting method, a main phase alloy for use in the two-alloy blending method having a small TRE and a high Pr content, with formation of α-Fe being greatly suppressed. The inventor has also found that a casting method including pouring a molten alloy into a rotary body, sprinkling the molten alloy by rotating the rotary body, and depositing and solidifying the sprinkled molten alloy on an inner surface of the cylindrical mold which is rotating (hereinafter referred to as a centrifugal force-sprinkled molten alloy-type centrifugal casting method) is particularly preferred as the centrifugal casting method.

The present inventor has also confirmed that, when no difference in amount of Pr added in a rare earth magnet (final product) exists between products, oxidation occurring during magnet production steps is inhibited more effectively for a rare earth magnet produced through the two-alloy blending method employing a main phase alloy according to the present invention containing most portions of Pr than for a rare earth magnet produced through a customary single-alloy method, thereby lowering processing cost, lowering the oxygen content of rare earth magnets, and improving characteristics of the magnets.

FIG. 1 shows a typical back-scattered electron image, observed under an SEM (scanning electron microscope), of a cross-section of a main phase alloy (TRE: 28.5% by mass, Nd:Pr=1:1 (in R), B: 1% by mass; and balance: Fe) flake for a rare earth magnet which has been cast through a conventional SC method.

In FIG. 1, the left side corresponds to the mold side, and the right side to the free surface side. On the mold side, the alloy flake has a surface roughness, as represented by 10-point average roughness (Rz), of 3.4 μm. In FIG. 1, white areas correspond to R-rich phase which assumes the form of lamellar portions extending in the thickness direction, or the form of a small pool of oriented lamellar fragments.

During casting of a main phase alloy through the SC method, a rare earth component contained in the molten alloy is oxidized to form a corresponding oxide, as the oxygen content of the atmosphere increases. The resultant oxide serves as a nucleation site for forming α-Fe, whereby precipitation of α-Fe is promoted. In another case, when the temperature of the molten alloy is lowered to a level near the liquidus, α-Fe is formed in the molten alloy. In still another case, when the cast flake is thick, the solidification rate particularly on the free surface side decreases, thereby readily forming α-Fe. Thus, in the above SC method, the oxygen content and temperature of the molten alloy are rigorously controlled during casting, and the thickness of cast flakes is controlled to as slightly thin as about 0.2 mm, so as to prevent formation of α-Fe. However, as shown in FIG. 1, α-Fe is precipitated in some sites on the free surface side of a main phase alloy flake for a rare earth magnet cast through the conventional SC method. In the back-scattered electron image shown in FIG. 1, α-Fe is observed as a portion of higher tint than that of $R_2Fe_{14}B$ phase (main phase), specifically as black dots in FIG. 1.

Figure 2:
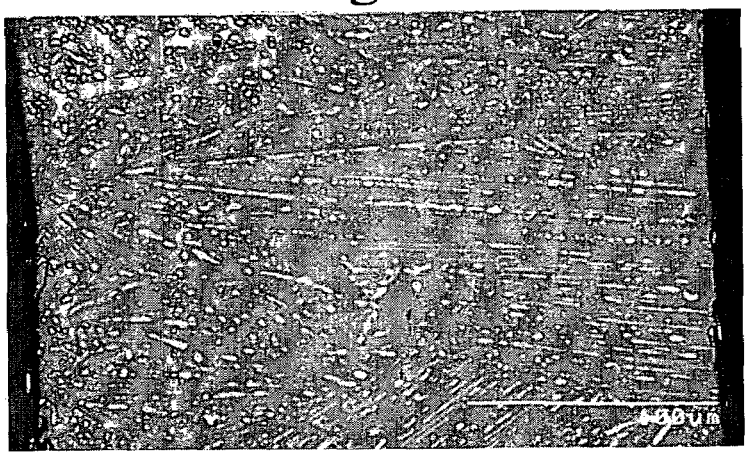
FIG. 2 is a photograph showing a cross section of an alloy flake for a rare earth magnet produced through the SC method according to the present invention.

FIG. 2 shows a back-scattered electron image of a flake of an alloy having a composition identical to that of the above alloy (FIG. 1), the flake having been produced through the improved SC method according to the present invention. In FIG. 2, the left side corresponds to the mold side, and the right side to the free surface side. The SC method employed in the present invention is characterized in that formation of α-Fe in an alloy is prevented by controlling the surface roughness of the mold side of a flake produced from the alloy. As shown in FIG. 2, the alloy flake produced through the improved SC method of the present invention contains no α-Fe, and homogeneity in R-rich phase dispersion state is satisfactory from the mold side to the free surface side.

Even when a conventional SC method is employed, the produced alloy flakes include, to some extent, those having a uniform microstructure free from α-Fe as shown in FIG. 2. However, alloy flakes containing α-Fe as shown in FIG. 1 are also produced simultaneously. Thus, the percent volume of α-Fe-containing region in the entire microstructure of the main phase alloy cannot be decreased to 5% or less. Difference in portions of microstructure of the alloy produced through a conventional SC method may be attributable to difference in conditions of contact between the roller surface and the molten alloy or alloy flake; e.g., the fine surface state of the rotating roller for casting, molten alloy supply conditions, and the atmosphere during casting.

Figure 3:
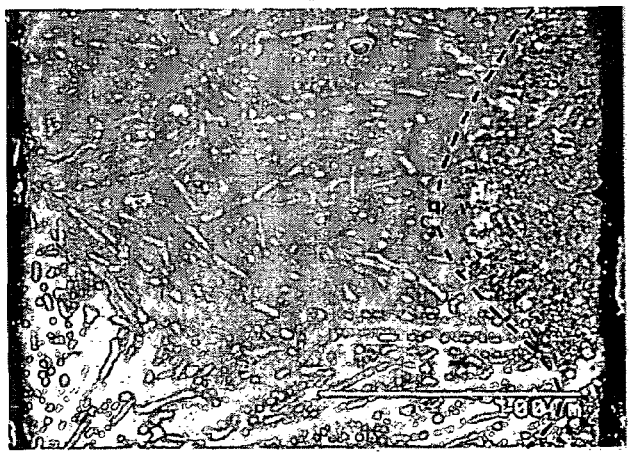
FIG. 3 is the photograph of FIG. 1, but α-Fe-containing region is enclosed by the dotted line.

The percent volume of α-Fe-containing region in the microstructure of a main phase alloy can be determined in the following manner. FIG. 3 is a back-scattered electron image of the same observation area as that of FIG. 1, but in FIG. 3 the α-Fe-containing region is enclosed by the line. Since α-Fe is precipitated as grains or dendrites over a comparatively wide area extending some tens of μm or more and the boundary between regions can be readily identified, the percent area of the α-Fe-containing region in the observation area can be calculated by means of a graphic image analyzer. The percent area in the cross-section corresponds to the percent volume of the alloy. As mentioned above, the percent volume of α-Fe-containing region varies depending on conditions of contact between the surface of a rotating roller for casting and the molten alloy or alloy flake as well as on the composition of the alloy. In addition, the surface of a rotating roller for casting is not completely uniform, and even a subtle change in amount of poured molten alloy varies the conditions of contact between the rotating roller for casting and the molten alloy. Therefore, the percent volume of α-Fe-containing region greatly varies among alloy flakes or within one alloy flake, even when the alloy flakes are produced under the same conditions. Thus, graphic image analysis is performed by use of about 5 to about 10 flakes under a wide observation area at a low magnification of about 100 to about 200 times, and obtained percent area values are averaged, to thereby calculate the percent volume of the α-Fe-containing region for the entirety of the alloy.

The relationship between the effect for preventing precipitation of α-Fe and the surface roughness of the mold side surface of an alloy flake produced through the SC method can be described as follows. In order to obtain a smooth mold side surface of an alloy flake, the surface of a rotating roller for casting must be smooth and have high wettability with respect to the molten alloy. When such a rotating roller is employed, heat is transferred from the molten alloy to the mold at remarkably high efficiency (i.e., heat transfer coefficient is high). Thus, the mold side alloy is rapidly cooled, solidified, and reduced in size, allowing rising, or exfoliation, of portions of the alloy from the surface of the rotating roller for casting. The heat transfer from the resultant portion to the roller greatly decreases, whereby the cooling efficiency thereafter is greatly decreases. Such a large decrease in solidification rate is considered to cause precipitation of α-Fe on the free surface side. Such a phenomenon is prone to occur, when the surface roughness of the rotating roller for casting is less than 5 μm.

According to the method for producing a main phase alloy for a rare earth magnet of the present invention including an SC method, the surface roughness, as represented by 10-point average roughness (Rz), of the surface of a rotating roller for casting is controlled to fall within a range of 5 μm to 100 μm, preferably within a range of 10 μm to 50 μm. When the surface of the rotating roller for casting is controlled to fall within the above range, the minute irregularities formed on the surface of the rotating roller for casting cannot be filled completely with the molten alloy, because of its viscosity. Thus, many portions of the alloy remain not in contact with the roller, thereby lowering the heat transfer coefficient. Although an excessive decrease in heat transfer coefficient induces precipitation of α-Fe, a surface roughness falling within the above range prevents precipitation of α-Fe, thereby appropriately controlling the heat transfer coefficient.

Through provision, on the surface of a rotating roller for casting, of a surface roughness falling within the above range, excessive heat transfer at an initial stage of solidification of molten alloy can be prevented, thereby preventing reduction in size of flakes formed of the alloy caused by rapid solidification. In addition, engagement of the surface of the rotating roller for casting to the irregularities of the alloy flake is also effective for preventing partial peeling of the alloy flake from the roller caused by solidification/reduction in size. Thus, formation of α-Fe in the alloy is considered to be prevented through a decreased change in solidification rate in a range of the mold side where solidification of the molten alloy begins to the free surface side where solidification complete.

When the surface roughness of the rotating roller for casting increases, the surface roughness of the mold side surface of the alloy flake necessarily increases, through transfer of the irregularities of the roller to the mold side surface of the alloy flake to some extent. According to the present invention, the surface roughness, as represented by 10-point average roughness (Rz), of the surface of a rotating roller for casting is controlled to fall within a range of 5 μm to 100 μm, preferably within a range of 10 μm to 50 μm. Thus, at least one surface of the as-cast alloy product has a surface roughness falling within a range of 5 μm to 50 μm, preferably 7 μm to 25 μm.

However, when the surface roughness of the rotating roller for casting is in excess of 100 μm, the surface roughness can be filled with the molten alloy, thereby increasing heat transfer coefficient and further increasing the surface roughness of the mold side of the produced alloy flake. In this case, although exfoliation of the alloy flake can be suppressed, uniformity in dispersion of R-rich phase cannot be attained due to large surface roughness, which is disadvantageous.

Figure 4A:
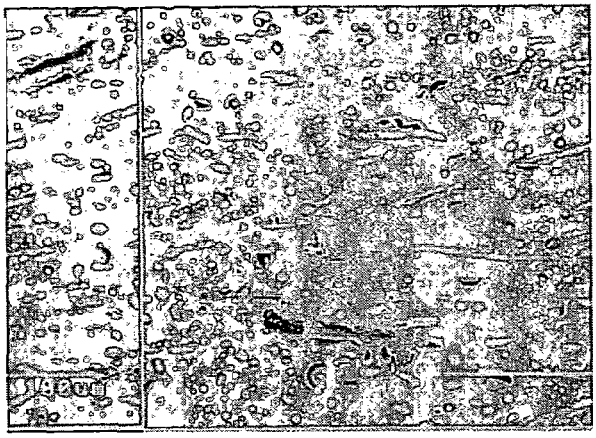
FIG. 4 shows photographs showing cross sections of an alloy flake for a rare earth magnet produced through the centrifugal casting method according to the present invention.
Figure 4B:
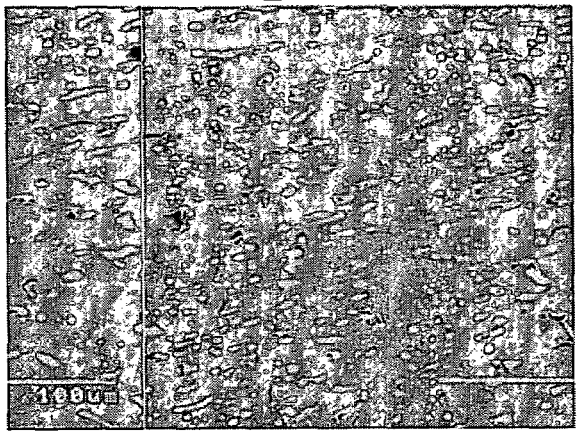
Figure 4C:
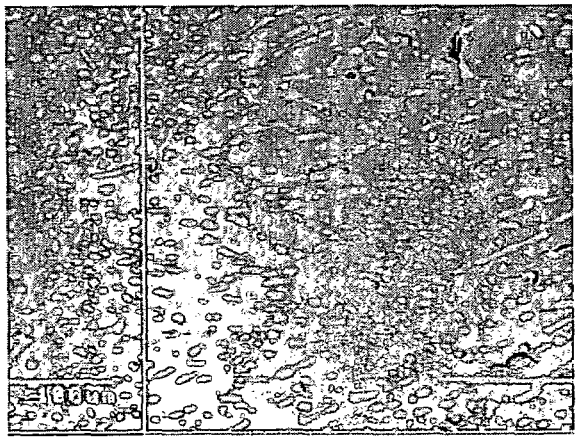

Another mode of the method for producing a main phase alloy for a rare earth magnet according to the present invention is a centrifugal casting method. For example, a molten alloy is sprinkled by a rotary body such as a rotatable tundish, to thereby greatly decreasing the rate for supplying a molten alloy. Thus, even when the alloy has a low TRE, a main phase is epitaxially grown, thereby preventing formation of α-Fe. FIG. 4 is a back-scattered electron image of a cross-section of an alloy having a composition identical to the alloy shown in FIG. 1 or 2 and produced through the above centrifugal casting method. In FIG. 4, the upper photograph shows a microstructure of a cross-section at a level from the mold side of 0.5 mm, the middle photograph shows a microstructure of a cross-section at a middle level, and the lower photograph shows a microstructure of a cross-section at a level from the free surface side of 0.5 mm. As is clear from FIG. 4, the main phase alloy having a composition identical to the alloy shown in FIG. 1 or 2 and produced through the above centrifugal casting method has a microstructure in which no α-Fe from the mold side to the free surface side is contained and R-rich phase is dispersed remarkably uniformly.

The elements of the present invention will next be described in detail.

(11) TRE in a Main Phase Alloy for a Rare Earth Magnet

According to the present invention, the TRE in the main phase alloy for a rare earth magnet is controlled to fall within a range of 26 to 30% by mass. When a sintered magnet is produced through the two-alloy blending method, the main phase alloy employed in the two-alloy blending method preferably has a low TRE for increasing the ratio of the boundary phase alloy in the mixture and facilitate mixing of the main phase alloy with the grain boundary phase. In consideration of the fact that high-performance magnet produced by use of R-T-B alloy generally has a TRE of about 32% by mass or less, the main phase alloy should have a TRE of 30% by mass or less, preferably 29% by mass or less. When the alloy has a stoichiometry of $Nd_2Fe_{14}B$, Nd content accounts for 26.7% by mass. When the TRE is less than the level, precipitation of α-Fe inevitably occurs. Therefore, a great decrease in TRE from the level is not possible, and the lower limit is 26% by mass. TRE is preferably 27% by mass or more.

(12) Pr Content of R

According to the present invention, the Pr content of R contained in the main phase alloy for a rare earth magnet is controlled to at least 5%. Conventionally, a main phase alloy having a small TRE to be processed by the two-alloy blending method suffers from problematic precipitation of α-Fe, when Nd is partially substituted by Pr (in R). Alternatively, Pr is added to the main phase alloy only when formation of α-Fe has been suppressed by controlling the levels of other components; i.e., by increasing the B content or adding Co. However, according to the improved SC method of the present invention or a centrifugal casting method which allows feeding of a molten alloy at such a low speed that the molten alloy is sprinkled by centrifugal force, precipitation of α-Fe is effectively suppressed. Even when Pr is added, α-Fe is difficult to precipitate. Thus, the Pr content of R can be controlled to at least 5%, even though the above component adjustment is omitted. In addition, the main phase alloy for a rare earth magnet of the present invention has a large degree of freedom in compositional design for magnet alloy, since the levels of other components is has not been modified; i.e., modification of B content or addition of Co has not been performed. In order to enhance the effect of addition of Pr, which is one characteristic of the present invention, the Pr content of R is controlled to preferably at least 15% by mass, more preferably at least 30% by mass.

(13) Percent Volume of α-Fe-Containing Region

According to the present invention, the main phase alloy has a percent volume of region containing α-Fe on the basis of the entire microstructure of 5% or less. α-Fe deteriorates efficiency of pulverizing the main phase alloy and induces variation in composition of the alloy. If α-Fe remains in magnets, magnetism is deteriorated. When the percent volume of the α-Fe-containing region is in excess of 5%, these drawbacks become critical. Through production by the aforementioned SC method or centrifugal casting method according to the invention, the percent volume of α-Fe-containing region in the microstructure of the main phase alloy of the present invention can be controlled to 5% or less, even when the Pr content of R is controlled to at least 5% by mass, preferably 15% by mass, more preferably 30% by mass.

(14) Surface Roughness of the Mold Side of an Alloy Flake Produced Through SC Method According to the present invention, the surface roughness of the main phase alloy flake produced through the strip casting method, as represented by 10-point average roughness (Rz), falls within a range of 5 μm to 50 μm. As mentioned above, when the surface roughness is 5 μm or less, variation in heat transfer between the roller for casting and the alloy flake increases during solidification, resulting in variation of the rate of solidification of the molten alloy. Thus, α-Fe is precipitated at some portions. When the surface roughness is 50 μm or more, although precipitation of α-Fe is inhibited, uniformity in R-rich phase dispersion is failed to be attained, which is disadvantageous.

Thus, the surface roughness of the mold side of the alloy flake preferably falls within a range of 7 μm to 25 μm.

Herein, the term "surface roughness" refers to a surface roughness determined under the conditions specified in JIS B 0601 "Surface roughness—Definitions and Designation," and 10-point average roughness (Rz) is defined therein. Specifically, a surface to be measured is cut with a plane which is perpendicular thereto, to thereby obtain a contour appearing on a cut end (profile curve). Any surface waviness component longer than a prescribed wavelength is cut off from the profile curve by means of a phase-compensation-type high-pass filter or a similar device, to thereby obtain a curve (roughness curve). Only the reference length is sampled from the roughness curve in the direction of its mean line, and the sum of the average value of absolute values of the heights of the five highest profile peaks (Yp) and the depths of the five deepest profile valleys (Yv) measured in the vertical direction from the mean line of this sampled portion is calculated, to thereby obtain the 10-point average roughness (Rz). Measurement parameters such as reference length are defined in the above JIS B 0601, as standard values of reference length for determining corresponding surface roughness values.

Since the surface roughness of the mold side of an alloy flake often varies in a wide range among samples to be measured, an average value of surface roughness for at least five flakes should be employed.

(15) Strip Casting (SC) Method

The method of producing R-T-B alloy for a rare earth magnet through the strip casting method will be described with reference to a sketch of an apparatus shown in FIG. 5.

Generally, a rare earth alloy is made molten by use of a refractory crucible 1 in vacuum or an inert gas atmosphere, because it is highly active. The thus-molten alloy is maintained at 1,350 to 1,500° C. for a predetermined period of time, and supplied, via a tundish 2 having optional flow-control means or slag-removing means, to a rotating roller 3 for casting whose interior is cooled with water. The rate of supplying the molten alloy and the rotation speed of the rotating roller are appropriately regulated in accordance with the thickness of the alloy flakes to be produced. Generally, the rotation speed of the rotating roller is about 1 to about 3 m/s (in terms of peripheral velocity). The rotating roller for casting is preferably made of copper or copper alloy, from the viewpoint of high thermal conductivity and availability. The surface of the rotating roller for casting is prone to adsorb metallic material, depending on the type of alloy to be produced and surface conditions of the rotating roller. Thus, provision of an optional cleaning apparatus stabilizes qualities of the cast alloy.

The alloy 4 solidified on the rotating roller is released from the roller on the side opposite the tundish side and collected into a collection container 5. The conditions of R-rich phase can be controlled by means of heating/cooling means provided in the collection container (Japanese Patent Application Laid-Open (kokai) Nos. 09-170055 and 10-36949).

(16) Centrifugal Casting Method

Similar to a conventional centrifugal casting method, the centrifugal casting method employed in the present invention includes feeding a molten metal into the interior of a cylindrical mold which is rotating, to thereby simultaneously deposit and solidify the molten metal. However, through employment of a conventional method in which the molten metal is caused to fall simply by gravity from holes provided in the tunduish, the rate of depositing molten metal is difficult to decrease, possibly precipitating α-Fe in the alloy. Thus, a casting method suitable for the present invention include feeding a molten alloy into a rotary body, forming droplets of the molten alloy by application of centrifugal force, and sprinkling the droplets, thereby depositing the alloy on the inner wall of the mold. Such a method can greatly decrease the deposition rate and increase solidification rate, and exerts greater effect for preventing precipitation of α-Fe, as compared with a conventional SC method (Japanese Patent Application No. 2000-262605).

Figure 6:
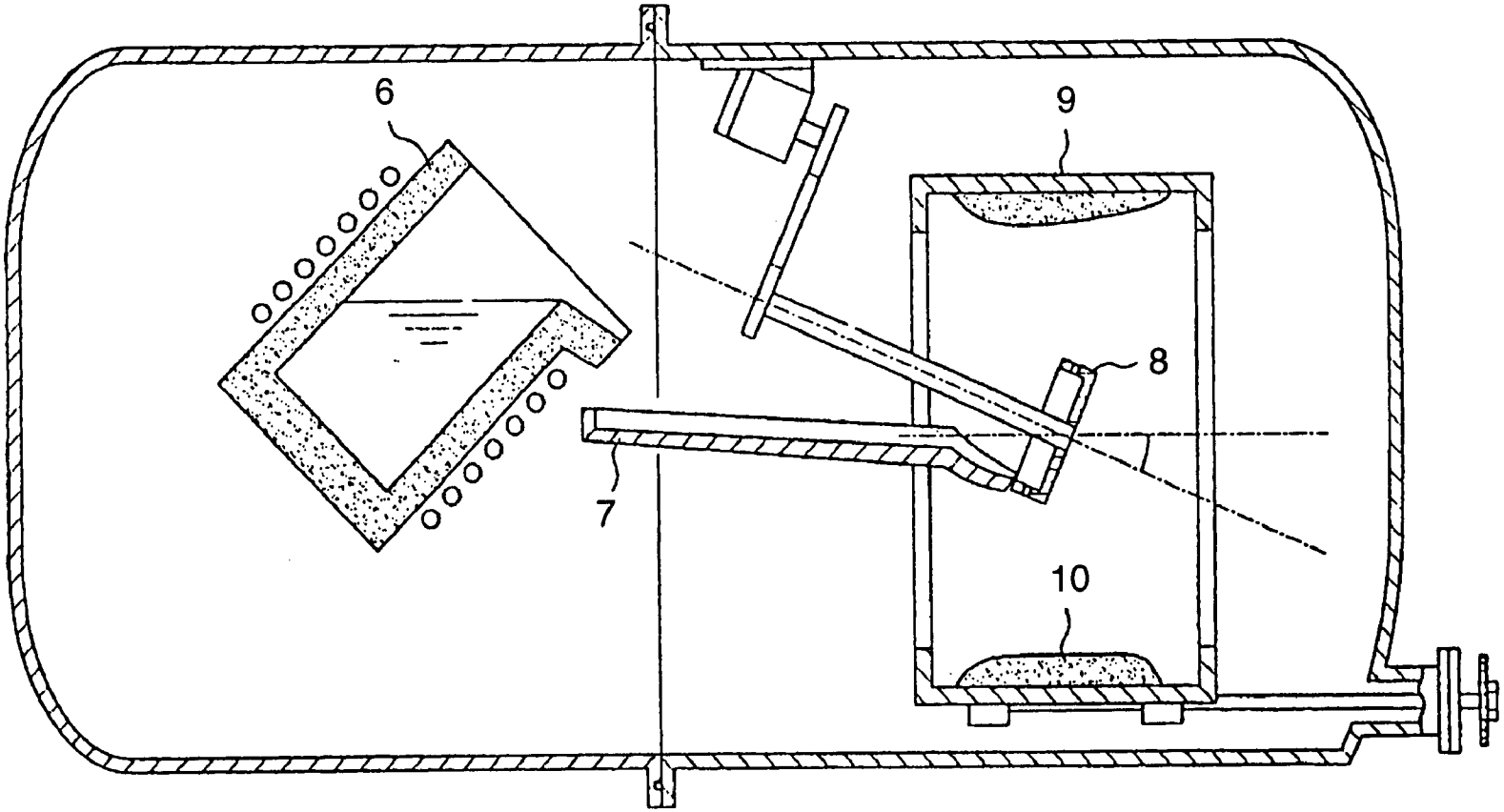
FIG. 6 is a sketch of a centrifugal casting apparatus for sprinkling molten alloy by centrifugal force and depositing the sprinkled alloy on the inner wall of the mold.

FIG. 6 is a sketch of an apparatus employed in a centrifugal casting method for sprinkling molten alloy by centrifugal force and depositing the alloy on the inner wall of the mold. Generally, a rare earth alloy is made molten by use of a refractory crucible 6 in vacuum or an inert gas atmosphere, because it is highly active. The thus-molten alloy is maintained at 1,350 to 1,500° C. for a predetermined period of time, and supplied, via a trough 7, to a rotary body 8. The molten alloy is caused to be sprinkled to the inner wall of a cylindrical mold 9 through rotation of the rotary body 8. Thus, the rate for pouring the molten alloy can be controlled, to thereby produce an alloy 10 at a desired deposition rate. If the axis of rotation of the rotary body 8 and the axis of rotation of the mold 9 form a certain angle, deposition area can be expanded over the inner wall of the mold in a longitudinal direction, thereby controlling the deposition rate of the molten metal.

(17) TRE and Pr Content of Boundary Phase Alloy

The main phase alloy for a rare earth magnet produced according to the present invention and to be subjected to the two-alloy blending method is mixed with a separately produced boundary phase alloy for a rare earth magnet to be subjected to the two-alloy blending method. The resultant mixture is pulverized, molded, and sintered, to thereby produce high-performance anisotropic magnets.

The boundary phase alloy predominantly provides R-rich grain boundary phase rather than $R_2T_{14}B$ phase (main phase), and therefore, has a TRE higher than that of the main phase alloy. According to the present invention, the Pr content of R contained in the boundary phase alloy is lower than that in the main phase alloy. As mentioned above, Pr is preferably added in a larger amount to the main phase alloy and in an amount as small as possible to the boundary phase alloy, from a viewpoint of corrosion resistance and orientation in a magnetic field. More preferably, the boundary phase alloy contains no substantial Pr, other than impurities present in the raw material.

(18) Methods for Producing Mixed Powder for a Rare Earth Sintered Magnet and Producing Rare Earth Magnets The main phase alloy and the boundary phase alloy for a rare earth magnet according to the present invention are typically performed sequentially in the order of hydrogen decrepitation and micro-pulverization, to thereby produce alloy powder having a size of approximately 3 μm (FSSS). Hydrogen decrepitation includes a hydrogen absorption step as a first step and a hydrogen desorption step as a second step. In the hydrogen absorption step, hydrogen is caused to be absorbed predominantly in the R-rich phase of alloy flakes in a hydrogen gas atmosphere at 266 hPa to 0.3 MPa·G. The R-rich phase is expanded in volume due to R hydride generated in this step, to thereby minutely break the alloy flakes themselves or generate numerous micro-cracks. Hydrogen absorption is carried out within a temperature range of ambient temperature to approximately 600° C. However, in order to increase expansion in volume of R-rich phase so as to effectively reduce the flakes in size, hydrogen absorption is preferably performed under increased pressure and within a temperature range of ambient temperature to approximately 100° C. The time for hydrogen absorption is preferably one hour or longer. The R hydride formed through the hydrogen absorption step is unstable in the atmosphere and readily oxidized. Thus, the hydrogen-absorbed product is preferably subjected to hydrogen desorption treatment by maintaining the alloy flakes at about 200 to about 600° C. in vacuum of 1.33 hPa or less. Through this treatment, R hydride can be transformed into a product stable in the atmosphere. The time for hydrogen desorption treatment is preferably 30 minutes or longer. If the atmosphere is controlled for preventing oxidation during steps to be carried out after hydrogen absorption to sintering, hydrogen desorption treatment can also be omitted.

Micro-pulverization is a step of pulverizing alloy flakes for attaining a particle size of approximately 3 μm (FSSS). Among pulverizers for performing the micro-pulverization, a jet mill is most preferred, because of attaining high productivity and a sharp particle size distribution profile. Upon micro-pulverization, the atmosphere is controlled to an inert gas atmosphere such as an argon gas atmosphere or nitrogen gas atmosphere. The inert gas may contain oxygen in an amount of 2% by mass or less, preferably 1% by mass or less. The presence of oxygen enhances pulverization efficiency and attains oxygen concentration of the powder produced through pulverization to 1,000 to 10,000 ppm, to thereby enhance oxidation resistance of the alloy powder. In addition, abnormal grain growth during sintering can also be prevented.

The main phase alloy and the boundary phase alloy are mixed at a predetermined compositional ratio. Mixing may be performed at any step; i.e., before hydrogen decrepitation, before micro-pulverization, or after micro-pulverization. When the two alloys are considerably different from each other in terms of pulverizability, mixing is preferably performed after completion of micro-pulverization. However, when only a small difference in terms of pulverizability is found between the two alloys, mixing may be performed before hydrogen decrepitation.

When the alloy powder for a rare earth magnet is molded in a magnetic field, in order to reduce friction between the powder and the inner wall of a mold and to reduce friction generated among powder particles for enhancing orientation, a lubricant such as zinc stearate is preferably added to the powder. The amount of the lubricant to be added is 0.01 to 1% by mass. Although the lubricant may be added before or after micro-pulverization, the lubricant is preferably mixed sufficiently, before molding in magnetic field, in an inert gas atmosphere such as argon gas or nitrogen gas by use of a mixing apparatus such as a V-blender.

The powder having a particle size of about 3 μm (FSSS) obtained through micro-pulverization is press-molded in magnetic field by use of a molding apparatus. The mold to be employed is fabricated from a magnetic material and a non-magnetic material in combination in consideration of the orientation of magnetic field in the mold cavity. The pressure at molding is preferably 0.5 to 2 t/cm$^2$, and the magnetic field in the mold cavity during molding is preferably 5 to 20 kOe. The atmosphere during molding is preferably an inert gas atmosphere such as argon gas or nitrogen gas. However, if the powder has been subjected to the aforementioned anti-oxidation treatment, molding can be performed in air. Molding may be performed through cold isostatic pressing (CIP) or rubber isostatic pressing (RIP) employing a rubber mold. Since the alloy powder is pressed isostatically through CIP or RIP, variation in orientation of magnetization during press-molding is lowered. Thus, the degree of orientation of the produced compact can be increased as compared with that produced by use of a metal mold, and maximum magnetic energy product can be enhanced.

Sintering of the compact for a rare earth magnet is performed at 1,000 to 1,100° C. Prior to reaching the sintering temperature, lubricant and hydrogen contained in the micro-powder must be removed as completely as possible. The lubricant is removed by maintaining the compact preferably under the conditions: in vacuum of $1.33\times10^{-2}$ hPa or under an argon gas flow atmosphere at reduced pressure; at 300 to 500° C.; and for 30 minutes or longer. Hydrogen is removed by maintaining the compact preferably under the conditions: in vacuum of $1.33\times10^{-2}$ hPa or less; at 700 to 900° C.; and for 30 minutes or longer. The atmosphere during sintering is preferably an argon gas atmosphere or a vacuum atmosphere of $1.33\times10^{-2}$ hPa or less. A retention time at the sintering temperature of one hour or longer is preferred.

After completion of sintering, in order to enhance the coercivity of sintered magnet to be produced, the sintered product may be treated at 500 to 650° C. in accordance with needs. An argon gas atmosphere or a vacuum atmosphere is preferred, and a retention time of 30 minutes or longer is preferred.

The rare earth magnet produced through the two-alloy blending method by use of a Pr-containing main phase alloy of the present invention is more excellent than a similar rare earth magnet produced through the single-alloy method by use of a raw material alloy containing a similar amount of Pr. The following is the conceivable advantages of the former rare earth magnet.

When the single-alloy method is employed, the composition of the raw material alloy for a rare earth magnet coincides approximately with that of the rare earth magnet (final product), and the difference between two compositions may be attributable to subtle compositional variation provided during production steps. The TRE is about 31 to about 33% by mass. The alloy powder has an R-rich phase content of about 5 to about 10%. When R is predominantly comprising Nd, Pr is prone to form R-rich phase rather than $R_2T_{14}B$ phase. Thus, Pr content becomes higher in the R-rich phase than in the entirety of the alloy. Therefore, R-rich phase, which per se is active is further activated, and oxidation readily occurs during pulverization involved in magnet production steps and in the resultant micro-powder. The excessively increased oxygen content deteriorates magnet characteristics. When the Pr content increases, thorough countermeasures for preventing oxidation during steps is required. Such countermeasures result in increased cost and decrease in production efficiency. In addition, when the Pr content of R-rich phase remains high after formation of a sintered magnet, corrosion resistance of the magnet decreases due to active R-rich phase which may also be present in the alloy or micro-powder.

In contrast, in the rare earth magnet according to the present invention produced through the two-alloy blending method, Pr is provided from the main phase alloy. Thus, the Pr content is high in $R_2T_{14}B$ phase which originally contains Pr and is low in R-rich phase. During sintering, Pr may diffuse from $R_2T_{14}B$ phase to R-rich phase, resulting in slight increase in Pr content of R-rich phase. Although the Pr content of R-rich phase slightly increases, increase in Pr content of R-rich phase can be suppressed more effectively as compared with a magnet produced through the single-alloy method employing a raw material alloy having a high Pr content of R-rich phase, whereby corrosion resistance can be improved. In addition, since the main phase alloy included in the raw material has a high Pr content, an anisotropic magnetic field in $R_2T_{14}B$ phase increases and ease of orientation during orientation in a magnetic field can be improved, thereby increasing magnetization and a degree of orientation of produced magnets.

EXAMPLES

Example 11

Neodymium, praseodymium, ferroboron, aluminum, and iron were mixed to thereby obtain the following alloy composition: TRE: 28.5% by mass (Nd:Pr=1:1 (in R)); B: 1.00% by mass; Al: 0.30% by mass; and a balance of iron. The resulting mixture was melted in an alumina crucible in an argon gas atmosphere (1 atm) by use of a high-frequency induction melting furnace. The resulting molten alloy was cast through strip casting, to thereby prepare alloy flakes.

The roller for casting having a diameter of 300 mm and made of pure copper was employed. During casting, the inside of the copper roller was cooled by water. The roller had a cast surface roughness, as represented by 10-point average roughness (Rz), of 20 μm and was rotated at a peripheral velocity of 0.9 m/s, to thereby produce alloy flakes having a mean thickness of 0.26 mm.

The thus-produced alloy flakes were found to have a surface (mold side) roughness, as represented by 10-point average roughness (Rz), of 9 μm. Ten flakes were selected from the alloy flakes and polished in a fixed state. Each flake was observed under a scanning electron microscope (SEM) and a back-scattered electron image (BEI) was captured at a magnification of ×200. Through analysis of the thus-captured photograph by means of an image graphic analyzer, the percent volume of α-Fe-containing region was found to be 1% or less.

Example 12

An alloy having a composition similar to that of the alloy of Example 11 was melted in an alumina crucible in an argon gas atmosphere by use of a high-frequency induction melting furnace. The resulting molten alloy was cast by use of a centrifugal casting apparatus including a rotatable tundish.

During casting, the molten alloy was deposited on the inner wall of the mold at an average deposition rate of 0.01 cm/s. The rotation rate of the mold was modified such that centrifugal force is adjusted to 3 G. Centrifugal force (about 20 G) was applied to the molten alloy contained in the rotatable tundish, to thereby sprinkle the molten alloy.

The thus-produced alloy flakes were found to have a thickness of 7 to 10 mm. From each alloy flake, each sample cut at levels in the thickness direction of 7 mm, 8.5 mm, and 10 mm was polished in a fixed state. Each flake was observed under a scanning electron microscope (SEM) and a back-scattered electron image (BEI) was captured at a magnification of ×200. Through analysis of four photographs captured from the mold side to the free surface side with equal intervals by means of an image graphic analyzer, the percent volume of α-Fe-containing region was found to be 1% or less.

Comparative Example 11

The procedure of Example 11 including preparing a raw material and melt-casting was repeated, except that a roller for casting having a surface roughness, as represented by 10-point average roughness (Rz), of 3.0 μm was employed.

The thus-produced alloy flakes were evaluated in a manner similar to that of Example 11. The alloy flakes were found to have a surface (mold side) roughness, as represented by 10-point average roughness (Rz), of 3.4 μm and to have a percent volume of α-Fe-containing region of 8%.

Working examples of production of rare earth magnets will next be described.

Example 13

The flakes of the main phase alloy produced in Example 11 were subjected to hydrogen decrepitation. Hydrogen absorption step—the step preceding hydrogen decrepitation—was performed under the conditions: 100% hydrogen atmosphere, 2 atm, and retention time of 1 hour. The temperature of the alloy flakes at the start of hydrogen absorption reaction was 25° C. Hydrogen desorption step—subsequent step—was performed under the conditions: vacuum of 0.133 hPa, 500° C., and retention time of 1 hour. To the powder produced through hydrogen decrepitation, zinc stearate powder was added in an amount of 0.07% by mass. The mixture was sufficiently mixed in a 100% nitrogen atmosphere by use of a V-blender, and then micro-pulverized by use of a jet mill in a nitrogen atmosphere incorporated with oxygen (4,000 ppm). The resultant powder was sufficiently mixed again in a 100% nitrogen atmosphere by use of a V-blender. The obtained powder was found to have an oxygen concentration of 1,800 ppm. Through analysis of the carbon concentration of the powder, the zinc stearate content of the powder was calculated to be 0.05% by mass.

The boundary phase alloy was prepared in the following manner. Neodymium, dysprosium, ferroboron, aluminum, cobalt, copper, and iron were mixed to thereby obtain the following alloy composition: Nd: 35.0% by mass; Dy: 20% by mass; B: 0.70% by mass; Al: 0.30% by mass; Co: 25.0% by mass; Cu: 1.00% by mass, and a balance of iron. The resulting mixture was melted in an alumina crucible in an argon gas atmosphere (1 atm) by use of a high-frequency induction melting furnace. The resulting molten alloy was cast through centrifugal casting. During casting, the molten alloy was deposited on the inner wall of the mold at an average deposition rate of 0.03 cm/s. The rotation rate of the mold was modified such that centrifugal force is adjusted to 20G The thus-produced alloy flakes were found to have a thickness of 8 to 11 mm.

In a manner similar to the case of the main phase alloy, the boundary phase alloy was subjected to hydrogen decrepitation, micro-pulverization, and mixing. The obtained powder was found to have an oxygen concentration of 3,000 ppm. Through analysis of the carbon concentration of the powder, the zinc stearate content of the powder was calculated to be 0.05% by mass.

The aforementioned main phase alloy and the boundary phase alloy were mixed at a ratio by weight of 9:1, and the mixture was sufficiently mixed by use of a V-blender. Subsequently, the thus-obtained powder was press-molded in a 100% nitrogen atmosphere and a lateral magnetic field by use of a molding apparatus. The molding pressure was 1.2 t/cm$^2$, and the magnetic field in the mold cavity was controlled to 15 kOe. The thus-obtained compact was maintained sequentially in vacuum of $1.33\times10^{-5}$ hPa at 500° C. for one hour, in vacuum of $1.33\times10^{-5}$ hPa at 800° C. for two hours, and in vacuum of $1.33\times10^{-5}$ hPa at 1,080° C. for two hours for sintering. The density of the sintered product was as sufficiently high as 7.5 g/cm$^3$ or more. The sintered product was further heat-treated at 530° C. for one hour in an argon atmosphere.

Magnet characteristics of the thus-produced sintered magnet were measured by means of a direct-current BH curve tracer. The results are shown in Table 1. The oxygen content of the main phase alloy micro-powder and the produced sintered magnet are also shown in Table 1.

Example 14

In a manner similar to that employed in Example 13, the main phase alloy flakes obtained in Example 12 were pulverized, to thereby yield a powder. The powder and a micro-powder of the boundary phase alloy similar to that produced in Example 13 were mixed in a manner similar to that of Example 13, to thereby produce a rare earth magnet. Magnet characteristics of the rare earth magnet produced in Example 14 and the oxygen content of the main phase alloy micro-powder and the produced sintered magnet are also shown in Table 1.

Comparative Example 12

In a manner similar to that employed in Example 13, the main phase alloy flakes obtained in Comparative Example 11 were pulverized, to thereby yield a micro-powder. During pulverization, the rate of pulverization by use of a jet mill was decreased by 10% (average), as compared with the main phase alloy flakes produced in Example 11. The powder and the micro-powder of the boundary phase alloy produced in Example 13 were mixed in a manner similar to that of Example 13, to thereby produce a rare earth magnet. Magnet characteristics of the rare earth magnet produced in Comparative Example 12 and the oxygen content of the main phase alloy micro-powder and the produced sintered magnet are also shown in Table 1.

TABLE 1

| | Oxygen content | Magnet | | | |
|---|---|---|---|---|---|
| | of main phase micro-powder (ppm) | Oxygen content (ppm) | Br (kG) | iHc (kOe) | $(BH)_{max}$ (MGOe) |
| Example. 13 | 1,800 | 2,200 | 13.3 | 18.8 | 41.7 |
| Example. 14 | 1,900 | 2,200 | 13.4 | 18.3 | 41.9 |
| Comp. Ex. 12 | 2,200 | 2,500 | 13.0 | 18.7 | 39.0 |
| Comp. Ex. 13 | 3,500 | 3,900 | 13.2 | 18.1 | 40.3 |

As is clear from Table 1, the rare earth magnet of Comparative Example 12 exhibits a smaller residual magnetization as compared with those of Examples 13 and 14. The small residual magnetization may be attributable to a slight increase in TRE of the micro-powder due to α-Fe which is not pulverized during jet-milling and remains in the jet mill.

Comparative Example 13

A rare earth magnet having a composition similar to that of the magnet obtained in Example 13 was produced through the single-alloy method.

The procedure of Example 11 including strip casting was repeated, except that the alloy composition was replaced by the following composition: TRE: 31.15% by mass (in R, Nd: 52.4% by mass, Pr: 41.2% by mass, and Dy: 6.4% by mass); B: 0.97% by mass; Al: 0.30% by mass; Co: 2.50% by mass, Cu: 0.10% by mass, and a balance of iron, to thereby produce alloy flakes.

In a manner similar to that of Example 13, the alloy flakes were pulverized, to thereby yield a micro-powder, and a magnet was produced only by use of the micro-powder as a magnet source. The oxygen content and magnet characteristics of the produced magnet are shown in Table 1. Analysis of the magnet produced in Comparative Example 13 has revealed that the difference in composition between this magnet and the magnet produced in Example 13 falls within a range of an analytical error.

As shown in Table 1, the rare earth magnet of Comparative Example 13 has a higher oxygen content and exhibits a smaller residual magnetization as compared with those of Examples 13 and 14. The above properties may be attributable to oxidation of micro-powder during magnet production steps and difference in orientation feature provided during orientation in a magnetic field.

Consequently, the first aspect of the present invention provides an alloy for a rare earth magnet in which formation of α-Fe is prevented, even when Nd is partially substituted by Pr which is advantageous both for cost and characteristics. When employed as a low-TRE main phase alloy to be processed by the two-alloy blending method, the alloy serves as a remarkably effective raw material for producing a rare earth magnet of excellent magnet characteristics.

In addition, when a rare earth magnet is produced by use of the Pr-containing main phase alloy for a rare earth magnet of the present invention and the boundary phase alloy having a low Pr content, Pr is provided from the main phase alloy to the magnet. Thus, the invention, which overcomes drawbacks of high-Pr-content rare earth magnets, can provide a magnet which has improved resistance to oxidation caused during production step, improved corrosion resistance, and improved orientation feature in a magnetic field.

Second Aspect

Figure 7:
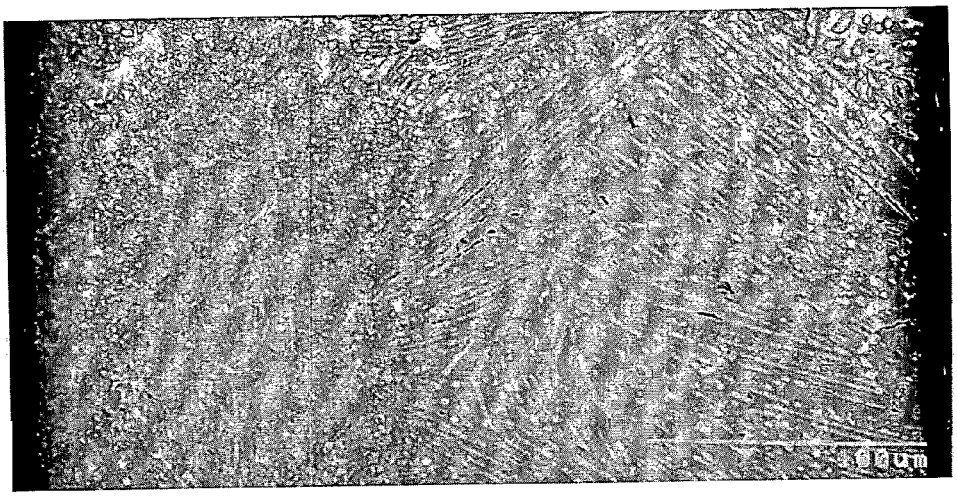
FIG. 7 shows the microstructure of a cross section of a rare earth magnet alloy flake containing fine R-rich phase region produced through a conventional SC method.

FIG. 7 shows a back-scattered electron image, observed under an SEM (scanning electron microscope), of a cross-section of an Nd—Fe—B alloy (Nd: 31.5 mass %) flake which has been cast through a conventional SC method. In FIG. 7, the left side corresponds to the mold side, and the right side to the free surface side. On the mold side, the alloy flake has a surface roughness, as represented by 10-point average roughness (Rz), of 3.4 μm.

In FIG. 7, white areas correspond to Nd-rich phase (R-rich phase is called Nd-rich phase, since R consists of Nd, here). From the center portion to the free surface side (the surface opposite the mold side) of the alloy flake, the Nd-rich phase assumes the form of lamellar portions extending in the thickness direction, or the form of a small pool of oriented lamellar fragments. In contrast, the Nd-rich phase on the mold side assumes very minute granular form as compared with other portions, and such granular Nd-rich phases are dispersed at random in a region on the mold side. The present inventor denominates such a region "fine R-rich phase region" (when R predominantly comprises Nd, the region is called fine Nd-rich phase region) and distinguishes this region from other regions. The fine R-rich phase region is generally formed from the mold side and extends to the center portion. A portion from the center to the free surface side where no fine R-rich phase region is present is called a "normal portion."

During hydrogen decrepitation of R-T-B alloy flakes for producing a sintered magnet, the volume of R-rich phase increases by absorbing hydrogen, thereby forming a fragile hydride. Thus, when hydrogen decrepitation is performed, microcracks are formed along or from the R-rich phase contained in the alloy. In the subsequent micro-pulverization step, the alloy flakes are crushed by virtue of a large amount of microcracks generated in hydrogen decrepitation. Therefore, when the R-rich phase is dispersed more finely in the alloy, the particle size of the resultant micro-powder tends to be smaller. Thus, as compared with a normal portion, the fine R-rich phase region is readily crushed to form minute particles. For example, the alloy powder obtained from a normal portion has an average particle size of about 3 μm as measured by means of FSSS (Fisher Sub-Sieve Sizer), whereas the alloy powder obtained from the fine R-rich phase region contains a large portion of micropowder having a particle size of 1 μm or less, resulting in a broad particle size distribution profile of the micropluverized product.

Japanese Patent Application Laid-Open (kokai) Nos. 09-170055 and 10-36949 disclose that the dispersion state of R-rich phase in an R-T-B alloy can be controlled by regulating a cooling rate of molten alloy solidified during casting or by heat treatment. However, in contrast to the case of a normal portion, behavior of the R-rich phase present in the fine R-rich phase region is difficult to control by regulating a cooling rate of solidified molten metal or by heat treatment, and the R-rich phase is not widely dispersed but remains finely dispersed.

Figure 9:
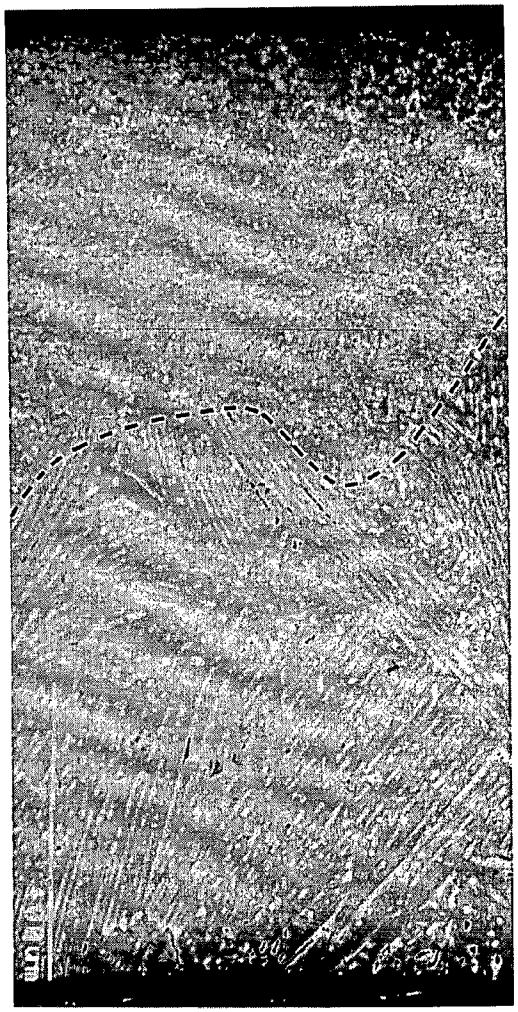
FIG. 9 shows the microstructure of the same observation area as that of FIG. 1, but the boundary between the fine R-rich phase region and the normal portion is shown by the dotted line.

The percent volume of the fine R-rich phase region can be determined in the following manner. FIG. 9 is a back-scattered electron image of the same observation area as that of FIG. 7, but in FIG. 9 the boundary between the fine R-rich phase region and the normal portion is specified by the line. Since the boundary between two regions can be readily identified through observation of the dispersion state of R-rich phase, the percent area of the fine R-rich phase region in the observation area can be calculated by means of a graphic image analyzer. The percent area in the cross-section corresponds to the percent volume of the alloy. Upon measurement of percent volume of fine R-rich phase region, the fine R-rich phase region content greatly varies among alloy flakes or within one alloy flake, even when the alloy flakes are cast simultaneously. Thus, graphic image analysis is performed by use of about 5 to about 10 flakes under a wide observation area at a low magnification of about 50 to about 100 times, and obtained percent area values are averaged, to thereby calculate the percent volume of the fine R-rich phase region for the entirety of the alloy.

Figure 8:
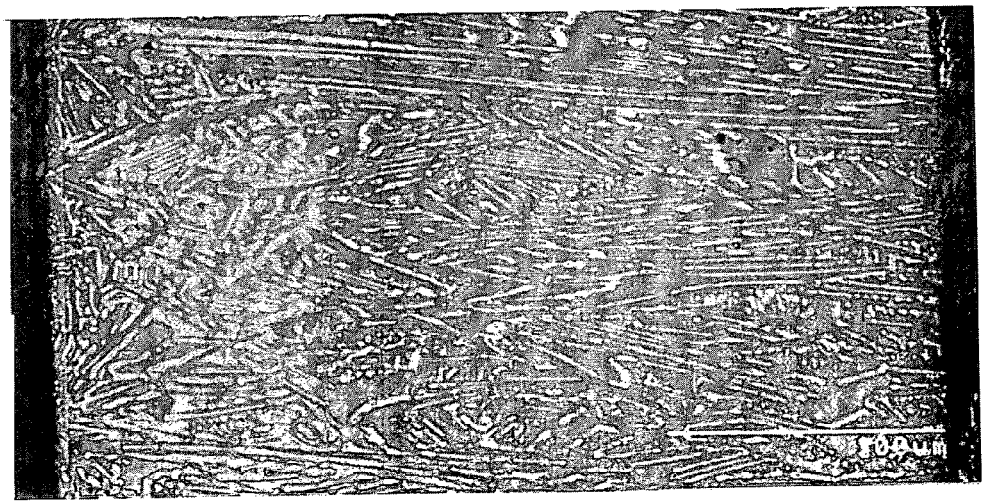
FIG. 8 shows the microstructure of a cross section of a rare earth magnet alloy flake according to the third Aspect of the present invention.

FIG. 8 is a back-scattered electron image of a cross-section of an R-T-B alloy flake (Nd: 31.5 mass %) falling within a scope of the present invention. In FIG. 8, the left side corresponds to the mold side and the right side to the free surface side. The alloy flake of the present invention is characterized in that formation of fine R-rich phase region is suppressed by means of controlling the roughness of the mold side surface of the flake produced through strip casting. As shown in FIG. 8, the alloy flake of the present invention contains no fine R-rich phase region on the mold side, and R-rich phase is dispersed, from the mold side to the free surface side, with remarkably excellent uniformity.

The relationship between the fine R-rich phase region and the surface roughness of the mold side surface of an alloy flake produced through the strip casting method can be described as follows.

In order to obtain a smooth mold side surface of an alloy flake, the surface of a rotating roller for casting must be smooth and have high wettability with respect to the molten alloy. When such a rotating roller is employed, heat is transferred from the molten alloy to the mold at remarkably high efficiency (i.e., heat transfer coefficient is high). Thus, the mold side alloy is rapidly cooled excessively. The fine R-rich phase region is considered to be highly prone to be generated through excessively rapid cooling of the portion of the alloy on the mold side resulting from the large heat transfer coefficient of the molten alloy to the mold.

In contrast, when the surface of the rotating roller for casting is finely roughened, the minute irregularities formed on the surface of the rotating roller for casting cannot be filled completely with the molten alloy, because of its viscosity. Thus, a portion of the alloy remains not in contact with the roller, thereby lowering the heat transfer coefficient. As a result, a portion of the alloy on the mold side is not rapidly cooled to an excessive extent. Accordingly, the above mechanism is considered to prevent generation of the fine R-rich phase region.

When the surface roughness of the rotating roller for casting increases, the surface roughness of the mold side surface of the alloy flake necessarily increases, through transfer of the irregularities of the roller to the mold side surface of the alloy flake to some extent. Thus, prevention of excessive heat transfer during solidification of the molten alloy, as described above, is considered to be the reason why generation of R-rich phase in an alloy flake having an appropriate surface roughness on the mold side is prevented.

However, when the surface roughness of the rotating roller for casting increases excessively, the irregularities can be filled with the molten alloy, thereby increasing heat transfer coefficient and further increasing the surface roughness of the mold side of the produced alloy flake. In this case, percent volume of the fine R-rich phase region increases.

Even when a conventional SC method is employed, the produced alloy flakes include, to some extent, those having a uniform microstructure as shown in FIG. 8. However, alloy flakes having large portions of fine R-rich phase regions as shown in FIG. 7 are also produced simultaneously, thereby deteriorating uniformity in the entire microstructure of the resultant alloy. Failure to attain uniformity in microstructure of the alloy produced through a conventional SC method is attributable to difference in conditions of contact between the roller surface and the molten alloy; e.g., the fine surface state of the rotating roller for casting, molten alloy supply conditions, and the atmosphere during casting.

In contrast, the rotating roller for casting according to the present invention is imparted with appropriate surface roughness. Thus, excessive heat transfer during solidification of molten alloy is prevented, to thereby suppress, at high reproducibility, generation of fine R-rich phase region. As a result, alloy flakes having such a uniform microstructure as shown in FIG. 8 can be produced at high yield.

The second aspect of the present invention will next be described in detail.

(21) Strip Casting Method

The present invention is drawn to an R-T-B alloy flake for rare earth magnets which is produced through the strip casting method. Herein, casting of R-T-B alloy through the strip casting method will be described.

Figure 5:
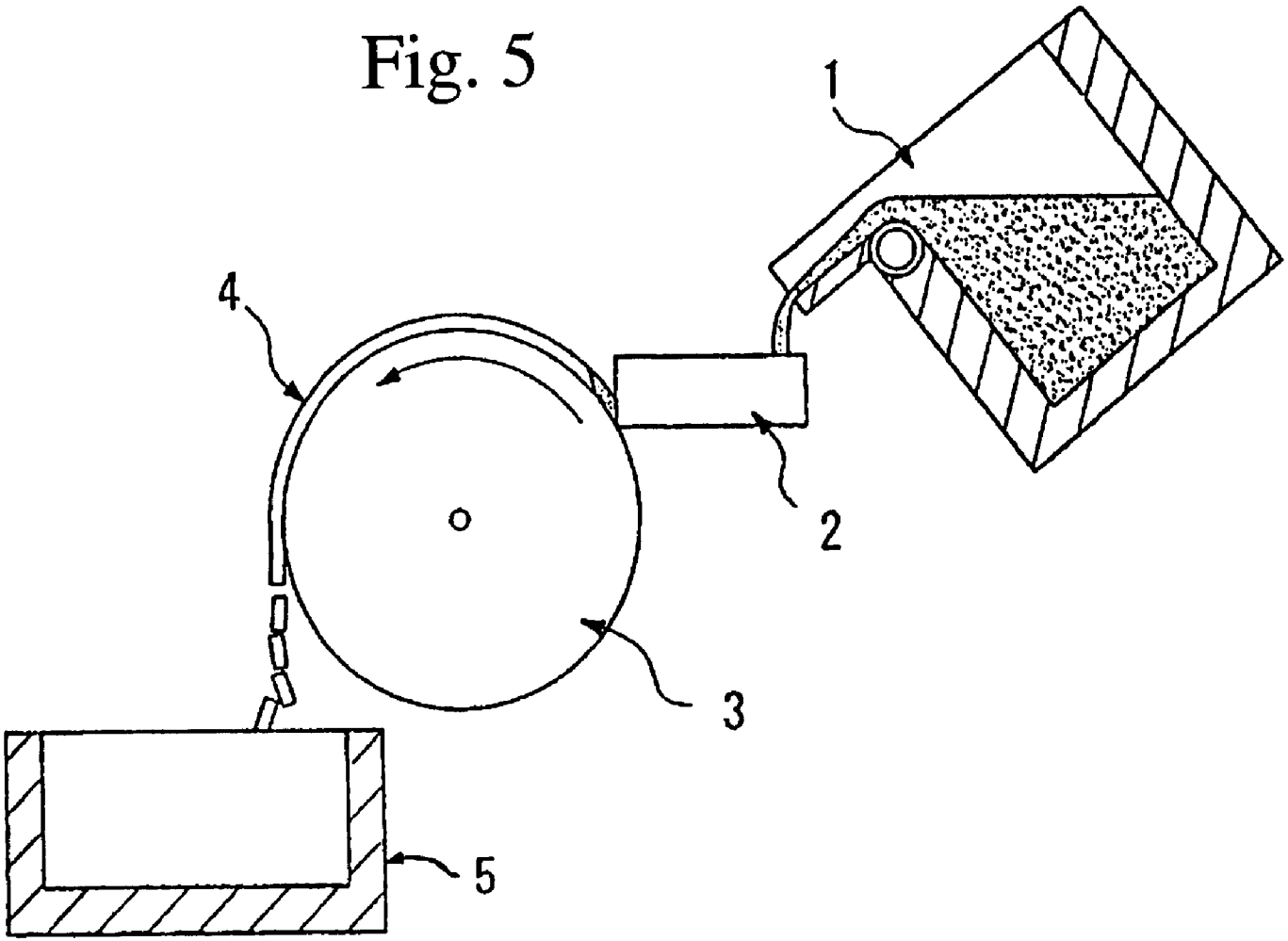
FIG. 5 is a sketch of a casting apparatus employed in a strip casting (SC) method.

FIG. 5 is a schematic view showing a casting apparatus employed in strip casting. Generally, when an R-T-B alloy is cast, the alloy is made molten by use of a refractory crucible 1 in vacuum or an inert gas atmosphere, because it is highly active. The thus-molten alloy is maintained at 1,350 to 1,500° C. for a predetermined period of time, and supplied, via a tundish 2 having optional flow-control means or slag-removing means, to a rotating roller 3 for casting whose interior is cooled with water. The rate of supplying the molten alloy and the rotation speed of the rotating roller are appropriately regulated in accordance with the thickness of the alloy flakes to be produced. Generally, the rotation speed of the rotating roller is about 1 to about 3 m/s (in terms of peripheral velocity). The rotating roller for casting is preferably made of copper or copper alloy, from the viewpoint of high thermal conductivity and availability. The surface of the rotating roller for casting is prone to adsorb metallic material, depending on the material and surface conditions of the rotating roller. Thus, provision of an optional cleaning apparatus stabilizes qualities of the cast R-T-B alloy. The alloy 4 solidified on the rotating roller is released from the roller on the side opposite the tundish side and collected into a collection container 5. The microstructure of R-rich phase present in the normal portion can be controlled by means of heating/cooling means provided in the collection container.

The alloy flake of the present invention preferably has a thickness of at least 0.1 mm and not greater than 0.5 mm. When the thickness of the alloy flake is less than 0.1 mm, solidification rate increases excessively, thereby providing an excessively small crystal grain size, which can be equivalent to the particle size of micro-pulverized powder applied to the magnet production step. In this case, percent orientation and magnetization of the produced magnets are problematically deteriorated. A thickness of the alloy flake in excess of 0.5 mm results in problems, such as deterioration of Nd-rich phase dispersibility stemming from a decrease in solidification rate, and problematic precipitation of α-Fe.

(22) Surface Roughness of the Cast Surface of the Rotating Roller for Casting

According to the present invention, when an R-T-B magnet alloy is cast through a strip casting method, the surface roughness, as represented by 10-point average roughness (Rz), of the cast surface of a rotating roller for casting is controlled to fall within a range of 5 μm to 100 μm.

Herein, the term "surface roughness" refers to a surface roughness determined under the conditions specified in JIS B 0601 "Surface roughness—Definitions and Designation," and 10-point average roughness (Rz) is defined therein. Specifically, a surface to be measured is cut with a plane which is perpendicular thereto, to thereby obtain a contour appearing on a cut end (profile curve). Any surface waviness component longer than a prescribed wavelength is cut off from the profile curve by means of a phase-compensation-type high-pass filter or a similar device, to thereby obtain a curve (roughness curve). Only the reference length is sampled from the roughness curve in the direction of its mean line, and the sum of the average value of absolute values of the heights of the five highest profile peaks (Yp) and the depths of the five deepest profile valleys (Yv) measured in the vertical direction from the mean line of this sampled portion is calculated, to thereby obtain the 10-point average roughness (Rz). Measurement parameters such as reference length are defined in the above JIS B 0601, as standard values of reference length for determining corresponding surface roughness values.

Since the surface roughness of the mold side of an alloy flake often varies in a wide range among samples to be measured, an average value of surface roughness for at least five flakes should be employed.

When the surface roughness is 5 μm or less, the effect of irregularities provided on the surface of the rotating roller for casting cannot be attained, thereby providing a large area of contact between the molten alloy and the roller and increasing the heat transfer coefficient. Thus, fine R-rich phase region is easily formed. When the surface roughness is 5 μm or more, the minute irregularities formed on the surface of the rotating roller cannot be completely filled with the molten alloy, because of its viscosity. Thus, many portions of the alloy remain not in contact with the roller, thereby lowering the heat transfer coefficient. As a result, formation of fine R-rich phase in the alloy can be prevented. The surface roughness, as represented by 10-point average roughness (Rz), is preferably at least 10 μm.

When the surface roughness of the rotating roller for casting is in excess of 100 μm, interspacing between peaks (or valleys) generally increases with the increase of the depth of the irregularities of the rotating roller. Thus, the molten alloy can enter cavities formed on the rotating roller, and the heat transfer coefficient readily increases excessively, thereby readily forming fine R-rich phase region in the alloy. Therefore, the surface roughness of the rotating roller for casting is regulated to be 100 μm or less, preferably 50 μm or less.

(23) Surface Roughness of R-T-B Alloy Flakes

According to the present invention, at least one surface of the R-T-B alloy flake for rare earth magnets has a surface roughness, as represented by 10-point average roughness (Rz), falling within a range of 5 μm to 50 μm. The side on which the above roughness is provided is the mold side where solidification starts during strip casting, and the surface roughness of the rotating roller is transferred to the mold side. As mentioned above, when the surface roughness of the mold side is 5 μm or less or at least 50 μm, percent volume of the formed fine R-rich phase region increases, thereby failing to attain uniformity in dispersion state of the R-rich phase in the alloy. As a result, the particle size distribution profile of the alloy powder micro-pulverized for producing sintered magnets becomes broad, thereby deteriorating magnet characteristics, which is undesirable. Thus, one surface of the alloy flake of the present invention preferably has a surface roughness falling within a range of 5 μm to 50 μm, more preferably within a range of 7 μm to 25 μm.

(25) Percent Volume of Fine R-Rich Phase Region in the Alloy

According to the present invention, the percent volume of fine R-rich phase region in an R-T-B alloy is regulated to 20% or less. Thus, the alloy powder which has been micro-pulverized for producing sintered magnets has a sharp particle size distribution profile, thereby yielding sintered magnets without variation in characteristics.

Method for Producing Rare Earth Sintered Magnet Alloy Powder and Method for Producing Rare Earth Sintered Magnets The rare earth magnet alloy flakes formed of R-T-B alloy which have been cast through the method according to the present invention are pulverized, shaped, and sintered, to thereby produce anisotropic sintered magnets of excellent characteristics.

Typically, pulverization of the alloy flakes is sequentially performed in the order of hydrogen decrepitation and micro-pulverization, to thereby produce an alloy powder having a size of approximately 3 μm (FSSS).

In the present invention, hydrogen decrepitation includes a hydrogen absorption step as a first step and a hydrogen desorption step as a second step. In the hydrogen absorption step, hydrogen is caused to be absorbed predominantly in the R-rich phase of alloy flakes in a hydrogen gas atmosphere at 266 hPa to 0.3 MPa·G The R-rich phase is expanded in volume due to R hydride generated in this step, to thereby finely break the alloy flakes themselves or generate numerous micro-cracks. Hydrogen absorption is carried out within a temperature range of ambient temperature to approximately 600° C. However, in order to increase expansion in volume of R-rich phase so as to effectively reduce the flakes in size, hydrogen absorption is preferably performed under increased hydrogen gas pressure and within a temperature range of ambient temperature to approximately 100° C. The time for hydrogen absorption is preferably one hour or longer. The R hydride formed through the hydrogen absorption step is unstable in the atmosphere and readily oxidized. Thus, the hydrogen-absorbed product is preferably subjected to hydrogen desorption treatment by maintaining the alloy flakes at about 200 to about 600° C. in vacuum of 1.33 hPa or less. Through this treatment, R hydride can be transformed into a product stable in the atmosphere. The time for hydrogen desorption treatment is preferably 30 minutes or longer. If the atmosphere is controlled for preventing oxidation during steps to be carried out after hydrogen absorption to sintering, hydrogen desorption treatment can also be omitted.

The R-T-B alloy flake produced through the strip casting method according to the present invention is characterized in that R-rich phase is uniformly dispersed in the alloy flake. The average inter R-rich phase spacing, which depends on the particle size of the pulverized powder for producing magnets, is preferably 3 μm to 8 μm. During hydrogen decrepitation, cracks are introduced to the alloy flake along or from the R-rich phase therein. Therefore, micro-pulverization of a product which has undergone hydrogen decrepitation attains, to a maximum degree, the effect of the R-rich phase uniformly and finely dispersed in the alloy, thereby effectively producing an alloy powder exhibiting a remarkably sharp particle size distribution profile. When sintered magnets are produced without performing the hydrogen decrepitation step, the produced sintered magnets have poor characteristics (M. Sagawa et al., Proceeding of the 5th international conference on Advanced materials, Beijing, China (1999)).

Micro-pulverization is a step of pulverizing R-T-B alloy flakes for attaining a particle size of approximately 3 μm (FSSS). Among pulverizers for performing the micro-pulverization, a jet mill is most preferred, in view of high productivity and a sharp particle size distribution profile. By use of alloy flakes according to the present invention having a low fine R-rich phase region content, an alloy powder exhibiting a sharp particle size distribution profile can be produced at high efficiency without variation.

Upon micro-pulverization, the atmosphere is controlled to an inert gas atmosphere such as an argon gas atmosphere or nitrogen gas atmosphere. The inert gas may contain oxygen in an amount of 2% by mass or less, preferably 1% by mass or less. The presence of oxygen enhances pulverization efficiency and attains oxygen concentration of the powder produced through pulverization to 1,000 to 10,000 ppm, to thereby appropriately stabilize the alloy powder. In addition, abnormal grain growth during sintering to form magnets can be prevented.

When the alloy powder is molded in a magnetic field, in order to reduce friction between the powder and the inner wall of a mold and to reduce friction generated among powder particles for enhancing orientation, a lubricant such as zinc stearate is preferably added to the powder. The amount of the lubricant to be added is 0.01 to 1% by mass. Although the lubricant may be added before or after micro-pulverization, the lubricant is preferably mixed sufficiently, before molding in magnetic field, in an inert gas atmosphere such as argon gas or nitrogen gas by use of a mixing apparatus such as a V-blender.

The powder having a particle size of about 3 μm (FSSS) obtained through micro-pulverization is press-molded in magnetic field by use of a molding apparatus. The mold to be employed is fabricated from a magnetic material and a non-magnetic material in combination in consideration of the orientation of magnetic field in the mold cavity. The pressure at molding is preferably 0.5 to 2 t/cm$^2$, and the magnetic field in the mold cavity during molding is preferably 5 to 20 kOe. The atmosphere during molding is preferably an inert gas atmosphere such as argon gas or nitrogen gas. However, if the powder has been subjected to the aforementioned anti-oxidation treatment, molding can be performed in air.

Molding may be performed through cold isostatic pressing (CIP) or rubber isostatic pressing (RIP) employing a rubber mold. Since the alloy powder is pressed isostatically through CIP or RIP, variation in orientation during press-molding is lowered. Thus, the degree of orientation of the produced compact can be increased as compared with that produced by use of a metal mold, and maximum magnetic energy product can be enhanced.

Sintering of the compact is performed at 1,000 to 1,100° C. The atmosphere during sintering is preferably an argon gas atmosphere or a vacuum atmosphere of $1.33\times10^{-2}$ hPa or less. A retention time at the sintering temperature of one hour or longer is preferred. During sintering, prior to reaching the sintering temperature, lubricant contained in the compact and hydrogen contained in the alloy powder must be removed as completely as possible from a compact to be sintered. The lubricant is removed by maintaining the compact preferably under the conditions: in vacuum of $1.33\times10^{-2}$ hPa or less or under an argon gas flow atmosphere at reduced pressure; at 300 to 500° C.; and for 30 minutes or longer. Hydrogen is removed by maintaining the compact preferably under the conditions: in vacuum of $1.33\times10^{-2}$ hPa or less; at 700 to 900° C.; and for 30 minutes or longer.

After completion of sintering, in order to enhance the coercivity of sintered magnet to be produced, the sintered product may be treated at 500 to 650° C. in accordance with needs. An argon gas atmosphere or a vacuum atmosphere is preferred, and a retention time of 30 minutes or longer is preferred.

The rare earth magnet R-T-B alloy flake produced through the method according to the present invention in which formation of fine R-rich region is suppressed can be used suitably for producing bonded magnets as well as sintered magnets. Production of a bonded magnet by use of the rare earth magnet alloy flakes according to the present invention will next be described.

Firstly, the R-T-B alloy flakes of the present invention undergo heat treatment in advance in accordance with needs. The heat treatment is performed in order to remove α-Fe contained in the alloy and to coarsen crystal grains. The production steps of the alloy powder for producing bonded magnets include hydrogenation-disproportionation-desorption-recombination (HDDR) treatment. However, α-Fe present in the alloy cannot be removed in the HDDR treatment step, and remaining α-Fe deteriorates magnetism. Therefore, α-Fe must be removed prior to performing the HDDR treatment.

The alloy powder for producing bonded magnets has a mean particle size of 50 to 300 μm, which is considerably greater than that of the alloy powder for producing sintered magnets. When the bonded magnet alloy flakes undergo HDDR treatment, crystal orientation of recombined crystal grains of sub-micron size coincides with crystal orientation of crystal grains of the starting alloy flakes with a certain range of variance. Thus, when two or more crystal grains having different crystal orientations are contained in each of starting alloy flakes, each particle of the bonded magnet alloy powder produced from such alloy flakes will contain crystal grains having different crystal orientations. Thus, the alloy powder includes regions having great variance in crystal orientation. In such region, the degree of orientation deteriorates, and maximum magnetic energy product of the magnet is low. In order to avoid such deterioration, the crystal grains contained in the alloy flakes preferably have a large grain size. The alloy cast through a rapid-cooling/solidification method (e.g., strip casting) is prone to have a comparatively small crystal grain size. Thus, coarsening of crystal grains through heat treatment is effective for enhancing magnet characteristics.

There are many reports in connection with the method for producing a bonded magnet alloy powder through the HDDR method (e.g., T. Takeshita et al., Proc. 10th Int. Workshop on RE magnets and their application, Kyoto, Vol. 1, P. 551 (1989)). Production of the alloy powder through the HDDR method is performed in the following manner.

When R-T-B alloy flakes serving as raw material are heated in a hydrogen atmosphere, the $R_2T_{14}B$ phase—a magnetic phase—decomposes at about 700° C. to about 850° C., to thereby form three phases; i.e., α-Fe, $RH_2$, and $Fe_2B$. Subsequently, in order to remove hydrogen, the hydrogen atmosphere is replaced by an inert gas atmosphere or a vacuum atmosphere, and the temperature is maintained approximately in the above range. As a result, separated phases are recombined, to thereby form the $R_2T_{14}B$ phase having an approximately sub-micron crystal grain size. Upon the above process, if the composition of the alloy or treatment conditions are appropriately modified, the magnetization-easy axis of each recombined $R_2T_{14}B$ phase (C-axis of $R_2T_{14}B$ phase) is aligned approximately in parallel to the C-axis of $R_2T_{14}B$ phase present in the raw material alloy before decomposition. Thus, there can be produced an anisotropic magnet powder in which the magnetization-easy axis of minute crystal grains is aligned.

The alloy which has undergone HDDR treatment is pulverized to form an alloy powder having a particle size of about 50 to about 300 μm. By use of the alloy powder, a bonded magnet is produced through a process including mixing with resin and press-molding or injection-molding.

Similar to the case of the aforementioned hydrogen decrepitation, fine R-rich phase region is prone to form a micro-powder through HDDR treatment. Characteristics of the magnetic powder obtained through a HDDR method are deteriorated, as the particle size thereof decreases. Thus, the R-T-B alloy of the present invention in which formation of fine R-rich phase is suppressed is suitably used in production a bonded magnet powder including HDDR treatment.

EXAMPLES

Example 21

Neodymium, ferroboron, cobalt, aluminum, copper, and iron were mixed to thereby obtain the following alloy composition: Nd: 31.5% by mass; B: 1.00% by mass; Co: 1.0% by mass; Al: 0.30% by mass; Cu: 0.10% by mass; and a balance of iron. The resulting mixture was melted in an alumina crucible in an argon gas atmosphere (1 atm) by use of a high-frequency induction melting furnace. The resulting molten alloy was cast through strip casting, to thereby prepare alloy flakes.

The rotating roller for casting having a diameter of 300 mm and made of pure copper was employed. During casting, the inside of the copper roller was cooled by water. The roller had a cast surface roughness, as represented by 10-point average roughness (Rz), of 20 μm and was rotated at a peripheral velocity of 0.9 m/s, to thereby produce alloy flakes having a mean thickness of 0.30 mm.

The thus-produced alloy flakes were found to have a surface (mold side) roughness, as represented by 10-point average roughness (Rz), of 10 μm. Ten flakes were selected from the alloy flakes and polished in a fixed state. Each flake was observed under a scanning electron microscope (SEM) and a back-scattered electron image (BEI) was captured at a magnification of ×100. Through analysis of the thus-captured photograph by means of an image graphic analyzer, the percent volume of fine R-rich phase region was found to be 3% or less.

Example 22

The procedure of Example 21 including casting through an SC method was repeated, except that a raw material having the following alloy composition: Nd: 28.5%; B: 1.00% by mass; Co: 1.0% by mass; Al: 0.30% by mass; Cu: 0.10% by mass; and a balance of iron was used, to thereby produce alloy flakes.

The thus-produced alloy flakes were evaluated in a manner similar to that of Example 21. The alloy flakes were found to have a surface (mold side) roughness, as represented by 10-point average roughness (Rz), of 9 μm and to have a percent volume of fine R-rich phase region of 3% or less.

Comparative Example 21

The procedure of Example 21 including preparing a raw material, melting, and casting through an SC method was repeated, except that a rotating roller for casting having a surface roughness, as represented by 10-point average roughness (Rz), of 3.0 μm was employed, to thereby produce alloy flakes.

The thus-produced alloy flakes were evaluated in a manner similar to that of Example 21. The alloy flakes were found to have a surface (mold side) roughness, as represented by 10-point average roughness (Rz), of 3.3 μm and to have a percent volume of fine R-rich phase region of 41%.

Comparative Example 22

The procedure of Example 21 including preparing a raw material, melting, and casting through an SC method was repeated, except that a rotating roller for casting having a surface roughness, as represented by 10-point average roughness (Rz), of 120 μm was employed, to thereby produce alloy flakes.

The thus-produced alloy flakes were evaluated in a manner similar to that of Example 21. The alloy flakes were found to have a surface (mold side) roughness, as represented by 10-point average roughness (Rz), of 86 μm and to have a percent volume of fine R-rich phase region of 29%.

Working examples of production of sintered magnets will next be described.

Example 23

The alloy flakes produced in Example 21 were subjected to hydrogen decrepitation and micro-pulverization by use of a jet mill. Hydrogen absorption step—the step preceding hydrogen decrepitation—was performed under the conditions: 100% hydrogen atmosphere, 2 atm, and retention time of 1 hour. The temperature of the alloy flakes at the start of hydrogen absorption reaction was 25° C. Hydrogen desorption step—subsequent step—was performed under the conditions: vacuum of 0.133 hPa, 500° C., and retention time of 1 hour. To the resultant powder, zinc stearate powder was added in an amount of 0.07% by mass. The mixture was sufficiently mixed in a 100% nitrogen atmosphere by use of a V-blender, and then micro-pulverized by use of a jet mill in a nitrogen atmosphere incorporated with oxygen (4,000 ppm). The resultant powder was sufficiently mixed again in a 100% nitrogen atmosphere by use of a V-blender. The obtained powder was found to have an oxygen concentration of 2,500 ppm. Through analysis of the carbon concentration of the powder, the zinc stearate content of the powder was calculated to be 0.05% by mass. The mean particle sizes of the powder, as measured by means of a laser diffraction particle size distribution measurement apparatus, were found to be 5.10 μm (D50), 2.10 μm (D10), and 8.62 μm (D90).

Subsequently, the thus-obtained powder was press-molded in a 100% nitrogen atmosphere and a lateral magnetic field by use of a molding apparatus. The molding pressure was 1.2 t/cm$^2$, and the magnetic field in the mold cavity was controlled to 15 kOe. The thus-obtained compact was maintained sequentially in vacuum of $1.33\times10^{-5}$ hPa at 500° C. for one hour, in vacuum of $1.33\times10^{-5}$ hPa at 800° C. for two hours, and in vacuum of $1.33\times10^{-5}$ hPa at 1,050° C. for two hours for sintering. The density of the sintered product was as sufficiently high as 7.5 g/cm$^3$ or more. The sintered product was further heat-treated at 560° C. for one hour in an argon atmosphere, to thereby produce a sintered magnet.

Magnet characteristics of the sintered magnet were measured by means of a direct-current BH curve tracer. The results are shown in Table 2. The oxygen content and particle size of the raw micro-powder for producing the sintered magnet are also shown in Table 2.

Comparative Examples 23 and 24

In a manner similar to Example 23, alloy flakes produced in Comparative Examples 21 or 22 were pulverized, to thereby obtain a micro-powder. The procedure of molding and sintering performed in Example 23 was repeated, except that the temperature of sintering the micro-powder obtained from alloy flakes of Comparative Example 21 or 22 was elevated by 20° C. due to less sinterability of these micro-powders, to thereby produce a sintered magnet. Results of evaluation of a sintered magnet produced from the alloy flakes of Comparative Example 21 and that produced from the alloy flakes of Comparative Example 22 are shown in Table 2 in the columns of Comparative Examples 23 and 24, respectively.

Magnet characteristics of the sintered magnets were measured by means of a direct-current BH curve tracer. The results are shown in Table 2. The oxygen content and particle size of each raw micro-powder for producing the sintered magnet are also shown in Table 2.

TABLE 2

| | Micro-powder | | | | Magnet | | |
|---|---|---|---|---|---|---|---|
| | Oxygen content | Particle size (μm) | | | Br | iHc | $(BH)_{max}$ |
| | (ppm) | D10 | D50 | D90 | (kG) | (kOe) | (MGOe) |
| Example 23 | 2,500 | 2.1 | 5.1 | 8.6 | 13.6 | 14.5 | 44.7 |
| Comp. Ex. 23 | 3,300 | 1.6 | 4.9 | 8.8 | 13.5 | 13.6 | 43.6 |
| Comp. Ex. 24 | 3,100 | 1.8 | 5.0 | 8.8 | 13.6 | 13.9 | 44.2 |
| Example 24 | — | — | — | — | 9.1 | 13.5 | 18.1 |
| Comp. Ex. 25 | — | — | — | — | 9.1 | 12.6 | 17.5 |

As is clear from Table 2, micro-powders obtained in Comparative Examples 23 and 24 have a smaller D10 as compared with that of the micro-powder obtained in Example 23; i.e., contain large amounts of very minute particles having a particle size of less than about 1 μm. Since such minute powders are readily oxidized, micro-powders obtained in Comparative Examples 23 and 24 exhibit a slightly higher oxygen content as compared with that of the micro-powder of Example 23. Magnetic characteristics of the magnets obtained in Comparative Examples 23 and 24 are inferior to those of the magnet of Example 23. The poor characteristics are mainly considered to be attributed to coarsening of crystal grains, which is caused by increase in sintering temperature by 20° C. performed for enhancing sinterability lowered by increase in oxygen content.

Working examples of production of bonded magnets will next be described.

Example 24

The procedure of Example 21 including casting through an SC method was repeated, except that a raw material having the following alloy composition: Nd: 28.5%; B: 1.00% by mass; Co: 10.0% by mass; Ga: 0.5% by mass; and a balance of iron was used, to thereby produce alloy flakes.

The thus-produced alloy flakes were evaluated in a manner similar to that of Example 21. The alloy flakes were found to have a surface (mold side) roughness, as represented by 10-point average roughness (Rz), of 9 μm and to have a percent volume of fine R-rich phase region of 3% or less. The alloy flakes contain no α-Fe.

The above alloy flakes were subjected to HDDR treatment including annealing in hydrogen (1 atm) at 820° C. for one hour and subsequent annealing in vacuum at 820° C. for one hour. The resultant alloy powder was pulverized by means of a Brawn mill so as to have a particle size of 150 μm or less and blended with an epoxy resin (2.5% by mass). The resultant mixture was press-formed in a magnetic field of 1.5 T, to thereby obtain a bonded magnet. Magnetic characteristics of the bonded magnet are shown in Table 2.

Comparative Example 25

The procedure of Comparative Example 21 including melting and casting through an SC method was repeated, except that the alloy composition was replaced by the alloy composition employed in Example 24, to thereby produce alloy flakes. The thus-produced alloy flakes were evaluated in a manner similar to that of Example 21. The alloy flakes were found to have a surface (mold side) roughness, as represented by 10-point average roughness (Rz), of 3.1 μm and to have a percent volume of fine R-rich phase region of 40%.

Subsequently, a bonded magnet was produced in a manner similar to that of Example 4. Magnetic characteristics of the bonded magnet are shown in Table 2.

As is clear from Table 2, the bonded magnet produced in Example 24 exhibits more excellent magnetic characteristics than those of the bonded magnet produced in Comparative Example 25. The bonded magnet produced in Comparative Example 25 has a high percent volume of fine R-rich phase region and contains a large number of comparatively small grains having a grain size of 50 μm or less produced through HDDR treatment or pulverization. The poor magnetic characteristics are attributable to such a small grain size.

As a result, the alloy flakes according to the present invention, having a small percent volume of fine R-rich region, exhibit higher uniformity in R-rich phase dispersion state in the alloy as compared with conventional SC materials. Thus, sintered magnets produced from the alloy flakes and bonded magnets produced by use of the flakes through an HDDR method exhibit more excellent magnetic characteristics than those of conventional magnets.

Third Aspect

FIG. 7 shows a back-scattered electron image, observed under an SEM (scanning electron microscope), of a cross-section of an Nd—Fe—B alloy (Nd: 31.5 mass %) flake which has been cast through a conventional SC method. In FIG. 7, the left side corresponds to the mold side, and the right side to the free surface side. On the mold side, the alloy flake has a surface roughness, as represented by 10-point average roughness (Rz), of 3.4 μm. The surface is provided with elongated raised/dented segments extending in a direction almost in parallel.

In FIG. 7, white areas correspond to Nd-rich phase (R-rich phase is called Nd-rich phase, since R is Nd). From the center portion to the free surface side (the surface opposite the mold side) of the alloy flake, the Nd-rich phase assumes the form of lamellar portions extending in the thickness direction, or the form of a small pool of oriented lamellar fragments. In contrast, the Nd-rich phase on the mold side has considerably minute grains as compared with other portions, and such grains are present at random in a region on the mold side. The present inventor denominates such a region "fine R-rich phase region" (when R predominantly comprises Nd, the region is called fine Nd-rich phase region) and distinguishes this region from other regions. The fine R-rich phase region is generally formed from the mold side and extends to the center portion. A portion from the center to the free surface side where no fine R-rich phase region is present is called a "normal portion."

During hydrogen decrepitation of R-T-B alloy flakes for producing a sintered magnet, the volume of R-rich phase increases by absorbing hydrogen, thereby forming a fragile hydride. Thus, when hydrogen decrepitation is performed, microcracks are formed along or from the R-rich phase contained in the alloy. In the subsequent micro-pulverization step, the alloy flakes are crushed by virtue of a large amount of microcracks generated in hydrogen decrepitation. Therefore, when the R-rich phase is dispersed more finely in the alloy, the particle size of the resultant micro-powder tends to be smaller. Thus, as compared with a normal portion, the fine R-rich phase region is readily crushed to form minute particles. For example, the alloy powder obtained from a normal portion has an average particle size of about 3 μm as measured by means of FSSS (Fisher Sub-Sieve Sizer), whereas the alloy powder obtained from the fine R-rich phase region contains a large portion of micro-powder having a particle size of 1 μm or less, resulting in a broad particle size distribution profile of the micro-pulverized product.

Japanese Patent Application Laid-Open (kokai) Nos. 09-170055 and 10-36949 disclose that the dispersion state of R-rich phase in an R-T-B alloy can be controlled by regulating a cooling rate of molten alloy solidified during casting or by heat treatment. However, in contrast to the case of a normal portion, behavior of the R-rich phase present in the fine R-rich phase region is difficult to control by regulating a cooling rate of solidified molten metal or by heat treatment, and the R-rich phase is not widely dispersed but remains finely dispersed.

The percent volume of the fine R-rich phase region can be determined in the following manner. FIG. 9 is a back-scattered electron image of the same observation area as that of FIG. 7, but in FIG. 9 the boundary between the fine R-rich phase region and the normal portion is specified by the line. Since the boundary between two regions can be readily identified through observation of the dispersion state of R-rich phase, the percent area of the fine R-rich phase region in the observation area can be calculated by means of a graphic image analyzer. The percent area in the cross-section corresponds to the percent volume of the alloy. Upon measurement of percent volume of fine R-rich phase region, the fine R-rich phase region content greatly varies among alloy flakes or within one alloy flake, even when the alloy flakes are cast simultaneously. Thus, graphic image analysis is performed by use of about 5 to about 10 flakes under a wide observation area at a low magnification of about 50 to about 100 times, and obtained percent area values are averaged, to thereby calculate the percent volume of the fine R-rich phase region for the entirety of the alloy.

FIG. 8 is a back-scattered electron image of a cross-section of an R-T-B alloy flake (Nd: 31.5 mass %) falling within a scope of the Third Aspect of the present invention. In FIG. 8, the left side corresponds to the mold side and the right side to the free surface side. The alloy flake of the Third Aspect of the present invention is characterized in that formation of fine R-rich phase region is suppressed by means of controlling the roughness of the mold side surface of the flake produced through strip casting and by forming on the surface elongated raised/dented segments so as to cross one another. The alloy flake shown in FIG. 8 has a mold side roughness of 3.2 μm, which is approximately equal to that of the alloy flake shown in FIG. 7. However, the alloy flake of the present invention contains no fine R-rich phase region on the mold side, and R-rich phase is dispersed, from the mold side to the free surface side, with remarkably excellent uniformity.

The relationship between the fine R-rich phase region and the surface roughness of the mold side surface of an alloy flake produced through the strip casting method can be described as follows.

In order to obtain a smooth mold side surface of an alloy flake, the surface of a rotating roller for casting must be smooth and have high wettability with respect to the molten alloy. When such a rotating roller is employed, heat is transferred from the molten alloy to the mold at remarkably high efficiency (i.e., heat transfer coefficient is high). Thus, the mold side alloy is rapidly cooled excessively. The fine R-rich phase region is considered to be highly prone to be generated through excessively rapid cooling of the portion of the alloy on the mold side resulting from the large heat transfer coefficient of the molten alloy to the mold.

In contrast, when the surface of the rotating roller for casting is minutely roughened, the minute irregularities formed on the surface of the rotating roller for casting cannot be filled completely with the molten alloy, because of its viscosity. Thus, a portion of the alloy remains not in contact with the roller, thereby lowering the heat transfer coefficient. As a result, a portion of the alloy on the mold side is not rapidly cooled to an excessive extent. Accordingly, the above mechanism is considered to prevent generation of the fine R-rich phase region. When the surface roughness of the rotating roller for casting increases, the surface roughness of the mold side surface of the alloy flake necessarily increases, through transfer of the irregularities of the roller to the mold side surface of the alloy flake to some extent. Thus, prevention of excessive heat transfer during solidification of the molten alloy, as described above, is considered to be the reason why generation of R-rich phase in an alloy flake having an appropriate surface roughness on the mold side is prevented.

In connection with the morphology of raised/dented segments, when these segments are elongated segments which are not crossing one another, each of contact and non-contact portions between the molten alloy and the roller tends to extend along an elongated raised/dented segment. Accordingly, the internal microstructure is also prone to exhibit continuity along such a raised/dented segment. In this case, if a fine R-rich phase region is formed in an elongated raised/dented segment for some reason, there arises the risk of growth of the fine R-rich phase region in the entire portion of the elongated raised/dented segment.

However, when elongated raised/dented segments cross one another, the segments on the surface are fragmented, and the continuity of the internal microstructure of the alloy is cut at crossing points. Furthermore, an elongated raised segment is necessarily cut at a crossing point by a linear dented segment. At the raised segment, contact area between the molten alloy and the surface of the roller for casting increases, thereby promoting heat transfer. Thus, fine R-rich phase region is considered to be readily formed through rapid cooling/solidification. However, such a fragmented segment prevents extension of fine R-rich phase, even if the fine R-rich phase region is formed.

According to the method for producing a rare-earth-containing alloy flake including a strip casting method, a rotating roller for casting is employed, the roller having, on the cast surface, a plurality of elongated raised/dented segments formed so as to cross one another and having a surface roughness of the cast surface, as represented by 10-point average roughness (Rz), falling within a range of 3 μm to 30 μm. The method can provide a rare-earth-containing alloy flake, wherein at least one surface of the alloy flake has a plurality of elongated raised/dented segments formed so as to cross one another; and the surface having the elongated raised/dented segments has a surface roughness, as represented by 10-point average roughness (Rz), falling within a range of 3 μm to 30 μm. According to the Third Aspect of the present invention, formation of fine R-rich phase region is prevented, thereby attaining a uniform microstructure, even though the surface roughness is small compared with the case of the second Aspect of the present invention. In addition, since a small surface roughness of the rotating roller for casting decreases the amount of grind for regulating the roller surface, the service life of the rotating roller for casting can be prolonged. According to the Third Aspect of the present invention, standards for controlling surface conditions of the roller can be simplified, since effects exerted by surface roughness become smaller.

Even when a conventional SC method is employed, the produced alloy flakes include, to some extent, those having a uniform microstructure as shown in FIG. 8. However, alloy flakes having large portions of fine R-rich phase regions as shown in FIG. 7 are also produced simultaneously, thereby deteriorating uniformity in the entire microstructure of the resultant alloy. Failure to attain uniformity in microstructure of the alloy produced through a conventional SC method may be attributable to difference in conditions of contact between the roller surface and the molten alloy; e.g., the fine surface state of the rotating roller for casting, molten alloy supply conditions, and the atmosphere during casting. Surface irregularity provided on the surface of a rotating roller for casting prevents excessive heat transfer during solidification of molten alloy, to thereby suppress, at high reproducibility, generation of fine R-rich phase region.

In addition, according to the Third Aspect of the present invention, elongated raised/dented segments which cross one another are provided on the surface of a rotating roller for casting. Thus, effect of preventing formation of fine R-rich phase region is strengthened and is satisfactory, even when the surface roughness is comparatively small. As a result, alloy flakes having such a uniform microstructure as shown in FIG. 8 can be produced at high yield.

The present invention will next be described in detail.

(31) Strip Casting (SC) Method

The present invention is drawn to a rare-earth-containing alloy flake which is produced through the strip casting method. Herein, casting of R-T-B alloy through the strip casting method will be described.

FIG. 4 is a schematic view showing a casting apparatus employed in strip casting. Generally, when an R-T-B alloy is cast, the alloy is made molten by use of a refractory crucible 1 in vacuum or an inert gas atmosphere, because it is highly active. The thus-molten alloy is maintained at 1,350 to 1,500° C. for a predetermined period of time, and supplied, via a tundish 2 having optional flow-control means or slag-removing means, to a rotating roller 3 for casting whose interior is cooled with water. The rate of supplying the molten alloy and the rotation speed of the rotating roller are appropriately regulated in accordance with the thickness of the alloy flakes to be produced. Generally, the rotation speed of the rotating roller is about 1 to about 3 m/s (in terms of peripheral velocity). The rotating roller for casting is preferably made of copper or copper alloy, from the viewpoint of high thermal conductivity and availability. The surface of the rotating roller for casting is prone to adsorb metallic material, depending on the material and surface conditions of the rotating roller. Thus, provision of an optional cleaning apparatus stabilizes qualities of the cast R-T-B alloy. The alloy 4 solidified on the rotating roller is released from the roller on the side opposite the tundish side and collected into a collection container 5. The microstructure of R-rich phase present in the normal portion can be controlled by means of heating/cooling means provided in the collection container.

The alloy flake of the present invention preferably has a thickness of at least 0.1 mm and not greater than 0.5 mm. When the thickness of the alloy flake is less than 0.1 mm, solidification rate increases excessively, thereby providing an excessively small crystal grain size, which is equivalent to the particle size of micro-pulverized powder applied to the magnet production step. In this case, percent orientation and magnetization of the produced magnets are problematically deteriorated. A thickness of the alloy flake in excess of 0.5 mm results in problems, such as deterioration of Nd-rich phase dispersibility stemming from a decrease in solidification rate, and problematic precipitation of α-Fe.

(32) Surface Roughness of the Cast Surface of the Rotating Roller for Casting

According to the Third Aspect of the present invention, when an R-T-B magnet alloy is cast through a strip casting method, the surface roughness, as represented by 10-point average roughness (Rz), of the cast surface of a rotating roller for casting is controlled to fall within a range of 3 μm to 30 μm.

Herein, the term "surface roughness" refers to a surface roughness determined under the conditions specified in JIS B 0601 "Surface roughness—Definitions and Designation," and 10-point average roughness (Rz) is defined therein. Specifically, a surface to be measured is cut with a plane which is perpendicular thereto, to thereby obtain a contour appearing on a cut end (profile curve). Any surface waviness component longer than a prescribed wavelength is cut off from the profile curve by means of a phase-compensation-type high-pass filter or a similar device, to thereby obtain a curve (roughness curve). Only the reference length is sampled from the roughness curve in the direction of its mean line, and the sum of the average value of absolute values of the heights of the five highest profile peaks (Yp) and the depths of the five deepest profile valleys (Yv) measured in the vertical direction from the mean line of this sampled portion is calculated, to thereby obtain the 10-point average roughness (Rz). Measurement parameters such as reference length are defined in the above JIS B 0601, as standard values of reference length for determining corresponding surface roughness values.

Since the surface roughness of the mold side of an alloy flake often varies in a wide range among samples to be measured, an average value of surface roughness for at least five flakes should be employed.

(33) Morphology of Surface Irregularity of the Cast Surface of a Rotating Roller for Casting According to the Third Aspect of the present invention, surface irregularities of the cast surface are generally provided by a plurality of elongated raised/dented segments formed on the cast surface so as to cross one another.

When these segments are in line form, each of contact and non-contact portions between the molten alloy and the roller tends to extend along an elongated raised/dented segment. Accordingly, the internal microstructure is also prone to exhibit continuity along such a raised/dented segment. In this case, if a fine R-rich phase region is formed in an elongated raised/dented segment for some reason, there arises the risk of growth of the fine R-rich phase region in the entire portion of the elongated raised/dented segment.

However, when elongated raised/dented segments cross one another, the segments on the surface are fragmented, and the continuity of the internal microstructure of the alloy is cut at crossing points. Thus, even though the fine R-rich phase region is formed, extension of fine R-rich phase can be prevented.

According to the Third Aspect of the present invention, uniform microstructure can be provided through effect of elongated raised/dented segments provided so as to cross one another, even though the surface roughness, as represented by 10-point average roughness (Rz), is comparatively small (i.e., falling within a range of 3 μm to 30 μm).

However, when the surface roughness is 3 μm or less, effect exerted by the presence of irregularities is unsatisfactory. Thus, heat transfer is promoted through increased contact between the molten alloy and the surface of a rotating roller for casting, thereby readily forming fine R-rich phase region in the alloy.

When the surface roughness of the rotating roller for casting is in excess of 30 μm, a solidified alloy flake is engaged with the roller surface and difficult to peel from the roller, thereby possibly causing trouble such as breakage of a tundish. Therefore, the surface roughness of the rotating roller for casting is controlled to 30 μm or less.

(34) Surface Roughness of Rare-Earth-Containing Alloy Flakes and Morphology of Irregularities According to the Third Aspect of the present invention, at least one surface of the rare-earth-containing alloy flake has a surface roughness, as represented by 10-point average roughness (Rz), falling within a range of 3 μm to 30 μm. The surface roughness is generally provided by a plurality of elongated raised/dented segments formed on the surface so as to cross one another.

The side on which irregularities of the above roughness are formed is the mold side where solidification starts during strip casting, and the surface irregularities of the rotating roller are transferred to the mold side. As mentioned above, when the surface roughness of the mold side is 3 μm or less, percent volume of the formed fine R-rich phase region increases, thereby failing to attain uniformity in dispersion state of the R-rich phase in the alloy. As a result, the particle size distribution profile of the alloy powder micro-pulverized for producing sintered magnets becomes broad, thereby deteriorating magnet characteristics, which is undesirable. When the surface roughness is 30 μm or more, trouble occurs readily in the course of casting of the alloy.

Thus, one surface of the alloy flake of the Third Aspect of the present invention preferably has a surface roughness falling within a range of 3 μm to 30 μm.

(35) Percent Volume of Fine R-Rich Phase Region in the Alloy

According to the present invention, the percent volume of fine R-rich phase region in an R-T-B alloy is regulated to 20% or less. Thus, the alloy powder which has been micro-pulverized for producing sintered magnets has a sharp particle size distribution profile, thereby yielding sintered magnets without variation in characteristics.

(36) Method for Producing Rare Earth Sintered Magnet Alloy Powder and Method for Producing Rare Earth Sintered Magnets The rare earth magnet alloy flakes formed of R-T-B alloy for producing a magnet which flakes have been cast through the method according to the present invention are pulverized, shaped, and sintered, to thereby produce anisotropic sintered magnets of excellent characteristics.

Typically, pulverization of the alloy flakes is sequentially performed in the order of hydrogen decrepitation and micro-pulverization, to thereby produce an alloy powder having a size of approximately 3 μm (FSSS). In the present invention, hydrogen decrepitation includes a hydrogen absorption step as a first step and a hydrogen desorption step as a second step. In the hydrogen absorption step, hydrogen is caused to be absorbed predominantly in the R-rich phase of alloy flakes in a hydrogen gas atmosphere at 266 hPa to 0.3 MPa. The R-rich phase is expanded in volume due to R hydride generated in this step, to thereby minutely break the alloy flakes themselves or generate numerous micro-cracks. Hydrogen absorption is carried out within a temperature range of ambient temperature to approximately 600° C. However, in order to increase expansion in volume of R-rich phase so as to effectively reduce the flakes in size, hydrogen absorption is preferably performed under increased hydrogen gas pressure and within a temperature range of ambient temperature to approximately 100° C. The time for hydrogen absorption is preferably one hour or longer. The R hydride formed through the hydrogen absorption step is unstable in the atmosphere and readily oxidized. Thus, the hydrogen-absorbed product is preferably subjected to hydrogen desorption treatment by maintaining the alloy flakes at about 200 to about 600° C. in vacuum of 1.33 hPa or less. Through this treatment, R hydride can be transformed into a product stable in the atmosphere. The time for hydrogen desorption treatment is preferably 30 minutes or longer. If the atmosphere is controlled for preventing oxidation during steps to be carried out after hydrogen absorption to sintering, hydrogen desorption treatment can also be omitted.

The R-T-B alloy flake produced through the strip casting method according to the present invention is characterized in that R-rich phase is uniformly dispersed in the alloy flake. The average inter R-rich phase spacing, which depends on the particle size of the pulverized powder for producing magnets, is preferably 3 μm to 8 μm. During hydrogen decrepitation, cracks are introduced to the alloy flake along or from the R-rich phase therein. Therefore, micro-pulverization of a product which has undergone hydrogen decrepitation attains, to a maximum degree, the effect of the R-rich phase uniformly and finely dispersed in the alloy, thereby effectively producing an alloy powder exhibiting a remarkably sharp particle size distribution profile. When sintered magnets are produced without performing the hydrogen decrepitation step, the produced sintered magnets have poor characteristics (M. Sagawa et al., Proceeding of the 5th international conference on Advanced materials, Beijing, China (1999)).

Micro-pulverization is a step of pulverizing R-T-B alloy flakes for attaining a particle size of approximately 3 μm (FSSS). Among pulverizers for performing the micro-pulverization, a jet mill is most preferred, in view of high productivity and a sharp particle size distribution profile. By use of alloy flakes according to the present invention having a low fine R-rich phase region content, an alloy powder exhibiting a sharp particle size distribution profile can be produced at high efficiency without variation.

Upon micro-pulverization, the atmosphere is controlled to an inert gas atmosphere such as an argon gas atmosphere or nitrogen gas atmosphere. The inert gas may contain oxygen in an amount of 2% by mass or less, preferably 1% by mass or less. The presence of oxygen enhances pulverization efficiency and attains oxygen concentration of the alloy powder produced through pulverization to 1,000 to 10,000 ppm, to thereby appropriately stabilize the alloy powder. In addition, abnormal grain growth during sintering to form magnets can be prevented.

When the alloy powder is molded in a magnetic field, in order to reduce friction between the powder and the inner wall of a mold and to reduce friction generated among powder particles for enhancing orientation, a lubricant such as zinc stearate is preferably added to the powder. The amount of the lubricant to be added is 0.01 to 1% by mass. Although the lubricant may be added before or after micro-pulverization, the lubricant is preferably mixed sufficiently, before molding in magnetic field, in an inert gas atmosphere such as argon gas or nitrogen gas by use of a mixing apparatus such as a V-blender.

The R-T-B alloy powder having a particle size of about 3 μm (FSSS) obtained through micro-pulverization is press-molded in magnetic field by use of a molding apparatus. The mold to be employed is fabricated from a magnetic material and a non-magnetic material in combination in consideration of the orientation of magnetic field in the mold cavity. The pressure at molding is preferably 0.5 to 2 t/cm$^2$, and the magnetic field in the mold cavity during molding is preferably 5 to 20 kOe. The atmosphere during molding is preferably an inert gas atmosphere such as argon gas or nitrogen gas. However, if the powder has been subjected to the aforementioned anti-oxidation treatment, molding can be performed in air.

Molding may be performed through cold isostatic pressing (CIP) or rubber isostatic pressing (RIP) employing a rubber mold. Since the alloy powder is pressed isostatically through CIP or RIP, variation in orientation of magnetization during press-molding is lowered. Thus, the degree of orientation of the produced compact can be increased as compared with that produced by use of a metal mold, and maximum magnetic energy product can be enhanced.

Sintering of the compact is performed at 1,000 to 1,100° C. The atmosphere during sintering is preferably an argon gas atmosphere or a vacuum atmosphere of $1.33\times10^{-2}$ hPa or less. A retention time at the sintering temperature of one hour or longer is preferred. During sintering, prior to reaching the sintering temperature, a lubricant and hydrogen must be removed as completely as possible from a compact to be sintered. The lubricant is removed by maintaining the compact preferably under the conditions: in vacuum of $1.33\times10^{-2}$ Pa or less or under an Ar flow atmosphere at reduced pressure; at 300 to 500° C.; and for 30 minutes or longer. Hydrogen is removed by maintaining the compact preferably under the conditions: in vacuum of $1.33\times10^{-2}$ hPa or less; at 700 to 900° C.; and for 30 minutes or longer.

After completion of sintering, in order to enhance the coercivity of sintered magnet to be produced, the sintered product may be treated at 500 to 650° C. in accordance with needs. An argon gas atmosphere or a vacuum atmosphere is preferred, and a retention time of 30 minutes or longer is preferred.

The rare earth magnet R-T-B alloy flake produced through the method according to the present invention in which formation of fine R-rich region is suppressed can be used suitably for producing bonded magnets as well as sintered magnets. Production of a bonded magnet by use of the rare earth magnet alloy flakes according to the present invention will next be described.

Firstly, the R-T-B alloy flakes of the present invention undergo heat treatment in advance in accordance with needs. The heat treatment is performed in order to remove α-Fe contained in the alloy and to coarsen crystal grains. The production steps of the alloy powder for producing bonded magnets include hydrogenation-disproportionation-desorption-recombination (HDDR) treatment. However, α-Fe present in the alloy cannot be removed in the HDDR treatment step, and remaining α-Fe deteriorates magnetism. Therefore, α-Fe must be removed prior to performing the HDDR treatment.

The alloy powder for producing bonded magnets has a mean particle size of 50 to 300 μm, which is considerably greater than that of the alloy powder for producing sintered magnets. When the bonded magnet alloy flakes undergo HDDR treatment, crystal orientation of recombined crystal grains of sub-micron size coincides with crystal orientation of crystal grains of the starting alloy flakes with a certain range of variance. Thus, when two or more crystal grains having different crystal orientations are contained in each of starting alloy flakes, each particle of the bonded magnet alloy powder produced from such alloy flakes will contain crystal grains having different crystal orientations. Thus, the alloy powder includes regions having great variance in crystal orientation. In such region, the degree of orientation deteriorates, and maximum magnetic energy product of the magnet is low. In order to avoid such deterioration, the crystal grains contained in the alloy flakes preferably have a large grain size. The alloy cast through a rapid-cooling/solidification method (e.g., strip casting) is prone to have a comparatively small crystal grain size. Thus, coarsening of crystal grains through heat treatment is effective for enhancing magnet characteristics.

There are many reports in connection with the method for producing a bonded magnet alloy powder through the HDDR method (e.g., T. Takeshita et al., Proc. 10th Int. Workshop on RE magnets and their application, Kyoto, Vol. 1, P. 551 (1989)). Production of the alloy powder through the HDDR method is performed in the following manner.

When R-T-B alloy flakes serving as raw material are heated in a hydrogen atmosphere, the $R_2T_{14}B$ phase—a magnetic phase—decomposes at about 700° C. to about 850° C., to thereby form three phases; i.e., α-Fe, $RH_2$, and $Fe_2B$. Subsequently, in order to remove hydrogen, the hydrogen atmosphere is replaced by an inert gas atmosphere or a vacuum atmosphere, and the temperature is maintained approximately in the above range. As a result, separated phases are recombined, to thereby form the $R_2T_{14}B$ phase having an approximately sub-micron crystal grain size. Upon the above process, if the composition of the alloy or treatment conditions are appropriately modified, the magnetization-easy axis of each recombined $R_2T_{14}B$ phase (C-axis of $R_2T_{14}B$ phase) is aligned approximately in parallel to the C-axis of $R_2T_{14}B$ phase present in the raw material alloy before decomposition. Thus, there can be produced an anisotropic magnet powder in which the magnetization-easy axis of minute crystal grains is aligned.

The alloy which has undergone HDDR treatment is pulverized to form an alloy powder having a particle size of about 50 to about 300 μm. By use of the alloy powder, a bonded magnet is produced through a process including mixing with resin and press-molding or injection-molding.

Similar to the case of the aforementioned hydrogen decrepitation, fine R-rich phase region is prone to form a micro-powder through HDDR treatment. Characteristics of the magnetic powder obtained through a HDDR method are deteriorated, as the particle size thereof decreases. Thus, the R-T-B alloy of the present invention in which formation of fine R-rich phase is suppressed is suitably used in production a bonded magnet powder including HDDR treatment.

Recently, it has been reported that surface roughness parameters (Sm/Ra and Sm) of the outer surface of a rotating roller for casting employed in the SC method are regulated within a specific range, to thereby improve uniformity in microstructure of the produced rare earth alloy (Japanese Patent Application Laid-Open (kokai) Nos. 2002-59245 and 9-1296). However, the above regulation is carried out in order to prevent change in microstructure in a direction of strip width and to prevent lowering of cooling rate at strip ends. In addition, the morphology of raised/dented segments which provide a surface roughness is not particularly specified.

In contrast, according to the present invention, change in microstructure on the alloy flake in a thickness direction; i.e., from the roller side to the free surface side is prevented, to thereby attain a uniform microstructure. The uniformity is determined on the basis of by fine R-rich phase region, and a specific range of percent volume thereof is provided. In this point, the present invention is completely different from the above inventions (Japanese Patent Application Laid-Open (kokai) Nos. 2002-59245 and 9-1296).

EXAMPLES

Example 31

Neodymium, ferroboron, cobalt, aluminum, copper, and iron were mixed to thereby obtain the following alloy composition: Nd: 31.5% by mass; B: 1.00% by mass; Co: 1.0% by mass; Al: 0.30% by mass; Cu: 0.10% by mass; and a balance of iron. The resulting mixture was melted in an alumina crucible in an argon gas atmosphere (1 atm) by use of a high-frequency induction melting furnace. The resulting molten alloy was cast through strip casting, to thereby prepare alloy flakes.

The rotating roller for casting having a diameter of 300 mm and made of pure copper was employed. During casting, the inside of the copper roller was cooled by water. The roller had a cast surface roughness, as represented by 10-point average roughness (Rz), of 4.0 μm. The surface roughness of the cast surface was generally provided by elongated raised/dented segments which extend in random directions and cross one another. The roller was rotated at a peripheral velocity of 1.0 m/s, to thereby produce alloy flakes having a mean thickness of 0.30 mm.

The thus-produced alloy flakes were found to have a surface (mold side) roughness, as represented by 10-point average roughness (Rz), of 4.6 μm. Ten flakes were selected from the alloy flakes and polished in a fixed state. Each flake was observed under a scanning electron microscope (SEM) and a back-scattered electron image (BEI) was captured at a magnification of ×100. Through analysis of the thus-captured photograph by means of an image graphic analyzer, the percent volume of fine R-rich phase region was found to be 3% or less.

Comparative Example 31

The procedure of Example 31 including preparing a raw material, melting, and casting through an SC method was repeated, except that a rotating roller for casting having a surface roughness, as represented by 10-point average roughness (Rz), of 4.0 μm was employed. The roller has, on the cast surface, elongated raised/dented segments which extend in a rotation direction almost in parallel, and has no substantial segments which cross the above linear segments.

The thus-produced alloy flakes were evaluated in a manner similar to that of Example 31. The alloy flakes were found to have a surface (mold side) roughness, as represented by 10-point average roughness (Rz), of 4.5 μm and to have a percent volume of fine R-rich phase region of 25%.

Comparative Example 32

The procedure of Example 31 including preparing a raw material, melting, and casting through an SC method was repeated, except that a rotating roller for casting having a surface roughness, as represented by 10-point average roughness (Rz), of 100 μm was employed. Similar to the case of Example 31, the surface roughness was generally provided by elongated raised/dented segments which cross one another.

In Comparative Example 32, a portion of metal remained in contact with the roller, without coming off the roller, and reached the tundish after one rotation of the roller. Since the front end of the tundish was broken by the alloy, casting operation was stopped.

Working examples of production of sintered magnets will next be described.

Example 32

The alloy flakes produced in Example 31 were subjected to hydrogen decrepitation and micro-pulverization by use of a jet mill. Hydrogen absorption step—the first step of hydrogen decrepitation—was performed under the conditions: 100% hydrogen atmosphere, 2 atm, and retention time of 1 hour. The temperature of the alloy flakes at the start of hydrogen absorption reaction was 25° C. Hydrogen desorption step—subsequent step—was performed under the conditions: vacuum of 0.133 hPa, 500° C., and retention time of 1 hour. To the resultant powder, zinc stearate powder was added in an amount of 0.07% by mass. The mixture was sufficiently mixed in a 100% nitrogen atmosphere by use of a V-blender, and then micro-pulverized by use of a jet mill in a nitrogen atmosphere incorporated with oxygen (4,000 ppm). The resultant powder was sufficiently mixed again in a 100% nitrogen atmosphere by use of a V-blender. The obtained powder was found to have an oxygen concentration of 2,500 ppm. Through analysis of the carbon concentration of the powder, the zinc stearate content of the powder was calculated to be 0.05% by mass. The mean particle sizes of the powder, as measured by means of a laser diffraction particle size distribution measurement apparatus, were found to be 5.00 μm (D50), 1.98 μm (D10), and 8.51 μm (D90).

Subsequently, the thus-obtained powder was press-molded in a 100% nitrogen atmosphere and a lateral magnetic field by use of a molding apparatus. The molding pressure was 1.2 t/cm$^2$, and the magnetic field in the mold cavity was controlled to 15 kOe. The thus-obtained compact was maintained sequentially in vacuum of $1.33\times10^{-5}$ hPa at 500° C. for one hour, in vacuum of $1.33\times10^{-5}$ hPa at 800° C. for two hours, and in vacuum of $1.33\times10^{-5}$ hPa at 1,050° C. for two hours for sintering. The density of the sintered product was as sufficiently high as 7.5 g/cm$^3$ or more. The sintered product was further heat-treated at 560° C. for one hour in an argon atmosphere, to thereby produce a sintered magnet.

Magnet characteristics of the sintered magnet were measured by means of a direct-current BH curve tracer. The results are shown in Table 3. The oxygen content and particle size of the raw micro-powder for producing the sintered magnet are also shown in Table 3.

Comparative Example 33

In a manner similar to Example 32, alloy flakes produced in Comparative Example 31 were pulverized, to thereby obtain a micro-powder. The procedure of molding and sintering performed in Example 32 was repeated, to thereby produce a sintered magnet.

Magnet characteristics of the sintered magnet produced in Comparative Example 33 were measured by means of a direct-current BH curve tracer. The results are shown in Table 3. The oxygen content and particle size of the raw micro-powder for producing the sintered magnet of Comparative Example 33 are also shown in Table 3.

TABLE 3

| | Micro-powder | | | | Magnet | | |
|---|---|---|---|---|---|---|---|
| | Oxygen content | Particle size (μm) | | | Br | iHc | $(BH)_{max}$ |
| | (ppm) | D10 | D50 | D90 | (kG) | (kOe) | (MGOe) |
| Example 32 | 2,400 | 2.0 | 5.0 | 8.5 | 13.6 | 14.5 | 44.5 |
| Comp. Ex. 33 | 3,000 | 1.6 | 5.0 | 8.8 | 13.5 | 13.8 | 43.5 |
| Example 33 | — | — | — | — | 9.1 | 13.4 | 18.0 |
| Comp. Ex. 34 | — | — | — | — | 9.1 | 12.7 | 17.3 |

As is clear from Table 3, a micro-powder obtained in Comparative Example 33 has a smaller D10 as compared with that of the micro-powder obtained in Example 32; i.e., contains large amounts of very minute particles having a particle size of less than about 1 μm. Since such a minute powder is readily oxidized, the micro-powder obtained in Comparative Example 33 exhibits a slightly higher oxygen content as compared with that of the micro-powder of Example 32. Magnetic characteristics of the micro-powder obtained in Comparative Example 33 are inferior to those of the micro-powder of Example 32. The poor characteristics are mainly considered to be attributed to an increase in oxygen content and poor uniformity in microcrystal structure.

Working examples of production of bonded magnets will next be described.

Example 33

The procedure of Example 31 including casting through an SC method was repeated, except that a raw material having the following alloy composition: Nd: 28.5%; B: 1.00% by mass; Co: 10.0% by mass; Ga: 0.5% by mass; and a balance of iron was used, to thereby produce alloy flakes.

The thus-produced alloy flakes were evaluated in a manner similar to that of Example 31. The alloy flakes were found to have a surface (mold side) roughness, as represented by 10-point average roughness (Rz), of 4.3 μm and to have a percent volume of fine R-rich phase region of 3% or less. The alloy flakes contain no α-Fe.

The above alloy flakes were subjected to HDDR treatment including annealing under hydrogen (1 atm) at 820° C. for one hour and subsequent annealing in vacuum at 820° C. for one hour. The resultant alloy powder was pulverized by means of a Brawn mill so as to have a particle size of 150 μm or less and blended with an epoxy resin (2.5% by mass). The resultant mixture was press-formed in a magnetic field of 1.5 T, to thereby obtain a bonded magnet. Magnetic characteristics of the bonded magnet are shown in Table 3.

Comparative Example 34

The procedure of Comparative Example 31 including melting and casting through an SC method was repeated, except that the raw material was replaced by the raw material employed in Example 33, to thereby produce alloy flakes. The thus-produced alloy flakes were evaluated in a manner similar to that of Example 31. The alloy flakes were found to have a surface (mold side) roughness, as represented by 10-point average roughness (Rz), of 4.8 μm and to have a percent volume of fine R-rich phase region of 30%.

Subsequently, a bonded magnet was produced by use of alloy flakes obtained in Comparative Example 34 in a manner similar to that of Example 33. Magnetic characteristics of the bonded magnet are shown in Table 3.

As is clear from Table 3, the bonded magnet produced in Example 33 exhibits more excellent magnetic characteristics than those of the bonded magnet produced in Comparative Example 34. The bonded magnet produced in Comparative Example 34 has a high percent volume of fine R-rich phase region and contains a large number of comparatively small grains having a grain size of 50 μm or less produced through HDDR treatment or pulverization. The poor magnetic characteristics are considered to be attributable to such a small grain size.

Effects of the Invention

The R-T-B alloy flakes according to the present invention, having a small percent volume of fine R-rich region, exhibit higher uniformity in R-rich phase dispersion state in the alloy as compared with alloy flakes produced through a conventional SC method. Thus, sintered magnets produced from the R-T-B alloy flakes of the present invention and bonded magnets produced by use of the flakes through an HDDR method exhibit more excellent magnetic characteristics than those of conventional magnets.

Fourth Aspect

FIG. 7 shows a back-scattered electron image, observed under an SEM (scanning electron microscope), of a cross-section of an Nd-Fe-B alloy (Nd: 31.5 mass %) flake which has been cast through a conventional SC method. In FIG. 7, the left side corresponds to the mold side, and the right side to the free surface side.

In FIG. 7, white areas correspond to Nd-rich phase (R-rich phase is called Nd-rich phase, since R is Nd). From the center portion to the free surface side (the surface opposite the mold side) of the alloy flake, the Nd-rich phase assumes the form of lamellar portions extending in the thickness direction, or the form of a small pool of oriented lamellar fragments. In contrast, the Nd-rich phase on the mold side has considerably minute grains as compared with other portions, and such grains are present at random in a region on the mold side. The present inventor denominates such a region "fine R-rich phase region" (when R predominantly comprises Nd, the region is called fine Nd-rich phase region) and distinguishes this region from other regions. The fine R-rich phase region is generally formed from the mold side and extends to the center portion. A portion from the center to the free surface side where no fine R-rich phase region is present is called a "normal portion".

During hydrogen decrepitation of R-T-B alloy flakes for producing a sintered magnet, the volume of R-rich phase increases by absorbing hydrogen, thereby forming a fragile hydride. Thus, when hydrogen decrepitation is performed, microcracks are formed along or from the R-rich phase contained in the alloy. In the subsequent micro-pulverization step, the alloy flakes are crushed by virtue of a large amount of microcracks generated in hydrogen decrepitation. Therefore, when the R-rich phase is dispersed more finely in the alloy, the particle size of the resultant micro-powder tends to be smaller. Thus, as compared with a normal portion, the fine R-rich phase region is readily crushed to form minute particles. For example, the alloy powder obtained from a normal portion has an average particle size of about 3 μm as measured by means of FSSS (Fisher Sub-Sieve Sizer), whereas the alloy powder obtained from the fine R-rich phase region contains a large portion of micropowder having a particle size of 1 μm or less, resulting in a broad particle size distribution profile of the micro-pulverized product.

Japanese Unexamined Patent Application, First Publication Nos. 09-170055 and 10-36949 disclose that the dispersion state of R-rich phase in an R-T-B alloy can be controlled by regulating a cooling rate of molten alloy solidified during casting or by heat treatment. However, in contrast to the case of a normal portion, behavior of the R-rich phase present in the fine R-rich phase region is difficult to control by regulating a cooling rate of solidified molten metal or by heat treatment, and the R-rich phase is not widely dispersed but remains finely dispersed.

The percent volume of the fine R-rich phase region can be determined in the following manner. FIG. 9 is a back-scattered electron image of the same observation area as that of FIG. 7, but in FIG. 9 the boundary between the fine R-rich phase region and the normal portion is specified by the line. Since the boundary between two regions can be readily identified through observation of the dispersion state of R-rich phase, the percent area of the fine R-rich phase region in the observation area can be calculated. The percent area in the cross-section corresponds to the percent volume of the alloy. The percent area in the cross-section can be determined rapidly and unambiguously by means of a graphic image analyzer.

Morphology, size and density of R-rich phase in the fine R-rich phase region are different from those of the normal portion. When the fine and generally spherical R-rich phase has a certain measure of density, it is possible to judge it as a fine R-rich phase region. A threshold value varies depending on the image quality of the back-scattered electron image used in graphic image analysis. However, the present inventors have found the following fact. That is, the portion wherein the density of R rich phase each having roundness of 1 to 1.4 and area of 5 $\mu m^2$ or less is 20 or more per 100 $\mu m^2$ is judged as a fine R-rich region. In case the portion, which does not correspond to the standard, exists at the mold side of the portion which corresponds to the standard, this mold sided portion is also judged as a fine R-rich region. The fine R-rich phase region can be measured with good reproducibility by this method. Herein, the term "roundness" refers to a value obtained by dividing (square of the circumference) of the subject figure by ($4\pi \times$area), and the roundness is 1 in case of circle and increases in case of elongated morphology. Furthermore, the present inventors have found that the percent volume thus calculated of the fine R-rich phase region can successfully describe the feature of the alloy structure and an influence on the particle size distribution profile after micro-pulverization and magnetic characteristics of the sintered magnet.

Upon measurement of percent volume of fine R-rich phase region, the fine R-rich phase region content greatly varies among alloy flakes or within one alloy flake, even when the alloy flakes are cast simultaneously. Thus, graphic image analysis is performed by use of about 5 to about 10 flakes and obtained percent area values are averaged, to thereby calculate the percent volume of the fine R-rich phase region for the entirety of the alloy.

Figure 10:
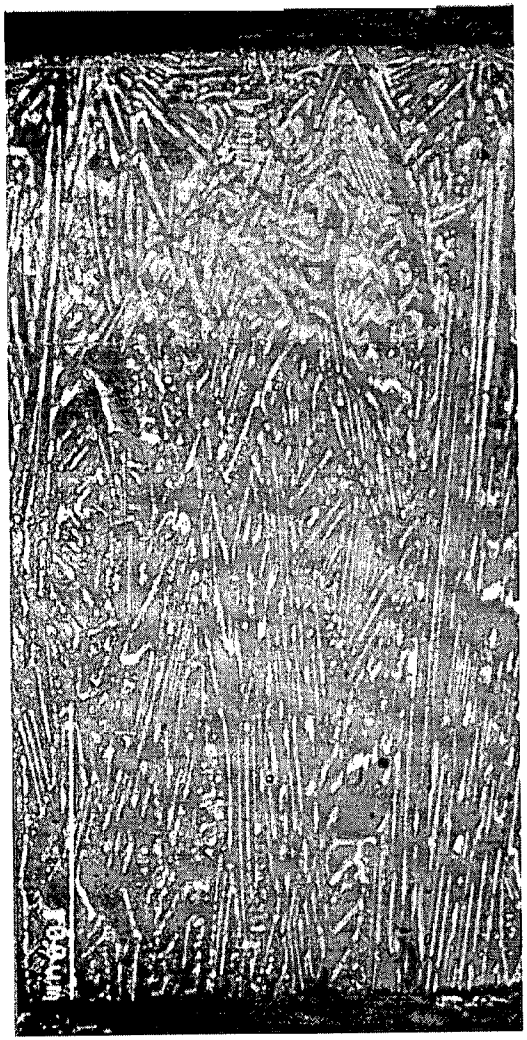
FIG. 10 shows the microstructure of a cross section of a rare earth magnet alloy flake according to the Fourth Aspect of the present invention.

FIG. 10 is a back-scattered electron image of a cross-section of an R-T-B alloy flake (Nd: 31.5 mass %) falling within a scope of the Fourth Aspect of the present invention. In FIG. 10, the left side corresponds to the mold side and the right side to the free surface side. The alloy flake of the Fourth Aspect of the present invention is characterized by employing a rotating roller for casting, the roller having a surface roughness provided by a plurality of elongated raised/dented segments formed on the cast surface, almost all of raised/dented segments extending in a direction forming at last a specific angle to a rotation direction of the roller for casting in the method for producing a rare-earth-containing alloy flake including a strip casting method. The alloy flake shown in FIG. 10 is produced by using a rotating roller for casting, which has the cast surface having the above construction and a surface roughness of 3.5 μm. As shown in FIG. 10, the alloy flake of the present invention contains no fine R-rich phase region on the mold side (left side in FIG. 10), and R-rich phase is dispersed, from the mold side to the free surface side, with remarkably excellent uniformity.

In contrast, the alloy flake shown in FIG. 7 is produced by using a rotating roller for casting, having, on the cast surface, elongated raised/dented segments which extend in a rotation direction almost in parallel. The surface roughness of the cast surface is almost the same as 3.3 μm, however, the percent volume of the fine R-rich phase region at the left side shown in the drawing is larger than that of the alloy flake shown in FIG. 10.

The relationship between the direction of elongated raised/dented segments on the surface of the rotating roller for casting and the fine R-rich phase region of the alloy flake in the strip casting method can be described as follows.

In case the surface of the rotating roller for casting is smooth and has high wettability with respect to the molten alloy, heat is transferred from the molten alloy to the mold at remarkably high efficiency (i.e., heat transfer coefficient is high). Thus, the mold side alloy is rapidly cooled excessively. The fine R-rich phase region is considered to be highly prone to be generated through excessively rapid cooling of the portion of the alloy on the mold side resulting from the large heat transfer coefficient of the molten alloy to the mold.

In contrast, when the surface of the rotating roller for casting is minutely roughened, the surface roughness of the rotating roller for casting increases. Therefore, the minute irregularities formed on the surface of the rotating roller for casting cannot be filled completely with the molten alloy, because of its viscosity. Thus, a portion of the alloy remains not in contact with the roller, thereby lowering the heat transfer coefficient. As a result, a portion of the alloy on the mold side is not rapidly cooled to an excessive extent. Accordingly, the above mechanism is considered to prevent generation of the fine R-rich phase region.

In connection with the morphology of raised/dented segments, when these segments are elongated segments, each of contact and non-contact portions between the molten alloy and the roller tends to extend along an elongated raised/dented segment. Accordingly, the internal microstructure is also prone to exhibit continuity along such a raised/dented segment. In this case, if a fine R-rich phase region is formed in an elongated raised/dented segment for some reason, there arises the risk of growth of the fine R-rich phase region in the entire portion of the elongated raised/dented segment.

The present inventors have found the following fact. That is, like the rotating roller for casting applied to the method of the Fourth aspect of the present invention, when elongated raised/dented segments are formed in a direction intersecting with the rotation direction of the rotating roller for casting, the continuity of the internal microstructure of the alloy flake along the extending direction of raised/dented segments can be lowered and also formation of the fine R-rich phase region can be suppressed.

The relationship between the direction of elongated raised/dented segments formed on the cast surface and the internal microstructure formed on the alloy flake is considered as follows. That is, in case elongated raised/dented segments extend in a rotation direction in parallel, or almost in parallel, when the molten alloy is contacted with the surface of the rotating roller, thereby to fill the space between raised/dented segments, an atmospheric gas in the dented portion is extruded to the rotation direction. As a result, the contact area between the surface of the roller and the molten alloy increases.

In contrast, in case elongated raised/dented segments extend in a direction intersecting with a roll rotation direction, as the angle between the both increases, an atmospheric gas in the dented portion of the surface of the rotating roller tends to be trapped with the molten alloy, thus making it possible to suppress excess contact between the surface of the roller and the molten alloy. Therefore, even though the surface roughness of the cast surface is the same, as the angle between the extending direction of elongated raised/dented segments and the roll rotating direction increases, the formation of the fine R-rich phase region tends to be suppressed. Also the continuity of the internal microstructure along the extending direction of raised/dented segments is lowered as compared with the case wherein the rotation direction corresponds to the extending direction of raised/dented segments. Therefore, if a fine R-rich phase region is formed, there arises the risk of growth of the fine R-rich phase region.

In the Fourth Aspect of the present invention, a rotating roller for casting is used, the roller being characterized by having, on the cast surface, a plurality of elongated raised/dented segments and having a surface roughness provided by a plurality of elongated raised/dented segments, as represented by 10-point average roughness (Rz), falling within a range of 3 μm to 60 μm, 30% or more of raised/dented segments among entire elongated raised/dented segments extending in a direction forming an angle of 30° or more to a roller rotation direction.

Preferably used is a rotating roller for casting, 30% or more of raised/dented segments among entire elongated raised/dented segments extending in a direction forming an angle of 45° or more to a roller rotation direction, or a rotating roller for casting, 50% or more of raised/dented segments among entire elongated raised/dented segments extending in a direction forming an angle of 30° or more to a roller rotation direction.

More preferably used is a rotating roller for casting, 50% or more of raised/dented segments among entire elongated raised/dented segments extending in a direction forming an angle of 45° or more to a roller rotation direction.

Herein, the term "angle between the extending direction of raised/dented segments and the roller rotating direction" is defined as 0° in case elongated raised/dented segments extend in a roller rotation direction in parallel, while it is defined as 90° in case elongated raised/dented segments extend in a roller width direction in parallel.

As a result, formation of fine R-rich phase region is prevented, thereby attaining a uniform microstructure, even though the surface roughness is small compared with the case wherein elongated raised/dented segments extend in a rotation direction almost in parallel. Since a small surface roughness of the rotating roller for casting decreases the amount of grind for regulating the roller surface, the service life of the rotating roller for casting can be prolonged. According to the Fourth Aspect of the present invention, standards for controlling surface conditions of the roller can be simplified, since effects exerted by surface roughness become smaller.

Even when a conventional SC method is employed, the produced alloy flakes include, to some extent, those having a uniform microstructure as shown in FIG. 10. However, alloy flakes having large portions of fine R-rich phase regions as shown in FIG. 7 are also produced simultaneously, thereby deteriorating uniformity in the entire microstructure of the resultant alloy. Failure to attain uniformity in microstructure of the alloy produced through a conventional SC method may be attributable to difference in conditions of contact between the roller surface and the molten alloy; e.g., the fine surface state of the rotating roller for casting, molten alloy supply conditions, and the atmosphere during casting.

Surface irregularity having proper size provided on the surface of a rotating roller for casting prevents excessive heat transfer during solidification of molten alloy, to thereby suppress, at high reproducibility, generation of fine R-rich phase region. In addition, according to the Fourth Aspect of the present invention, elongated raised/dented segments on the surface of the roller extend in the direction forming an angle to a rotation direction of a rotating roller for casting. Thus, effect of preventing formation of fine R-rich phase region is strengthened and is satisfactory, even when the surface roughness is comparatively small. As a result, alloy flakes having such a uniform microstructure as shown in FIG. 8 can be produced at high yield.

It is not necessarily that elongated raised/dented segments of the present invention are continuous, and may be intermittent. Also elongated raised/dented segments may in the form of curve or straight line.

The roller is preferably made of pure copper or a copper alloy. Also the cast surface layer can be coated in the present invention.

The present invention will next be described in detail.

(41) Strip Casting Method

The present invention is drawn to a rare-earth-containing alloy flake which is produced through the strip casting method. Herein, casting of R-T-B alloy through the strip casting method will be described.

FIG. 4 is a schematic view showing a casting apparatus employed in strip casting. Generally, when an R-T-B alloy is cast, the alloy is made molten by use of a refractory crucible 1 in vacuum or an inert gas atmosphere, because it is highly active. The thus-molten alloy is maintained at 1,350 to 1,500° C. for a predetermined period of time, and supplied, via a tundish 2 having optional flow-control means or slag-removing means, to a rotating roller 3 for casting whose interior is cooled with water. The rate of supplying the molten alloy and the rotation speed of the rotating roller are appropriately regulated in accordance with the thickness of the alloy flakes to be produced. Generally, the rotation speed of the rotating roller is about 0.5 to about 3 m/s (in terms of peripheral velocity). The rotating roller for casting is preferably made of copper or copper alloy, from the viewpoint of high thermal conductivity and availability. The surface of the rotating roller for casting is prone to adsorb metallic material, depending on the material and surface conditions of the rotating roller. Thus, provision of an optional cleaning apparatus stabilizes qualities of the cast R-T-B alloy. The alloy 4 solidified on the rotating roller is released from the roller on the side opposite the tundish side and collected into a collection container 5. The microstructure of R-rich phase present in the normal portion can be controlled by means of heating/cooling means provided in the collection container.

The alloy flake of the present invention preferably has a thickness of at least 0.1 mm and not greater than 0.5 mm. When the thickness of the alloy flake is less than 0.1 mm, solidification rate increases excessively, thereby providing an excessively small crystal grain size, which is equivalent to the particle size of micro-pulverized powder applied to the magnet production step. In this case, percent orientation and magnetization of the produced magnets are problematically deteriorated. A thickness of the alloy flake in excess of 0.5 mm results in problems, such as deterioration of R-rich phase dispersibility stemming from a decrease in solidification rate, and problematic precipitation of $\alpha$-Fe.

(42) Surface Roughness of the Cast Surface of the Rotating Roller for Casting

According to the Fourth Aspect of the present invention, when an R-T-B magnet alloy is cast through a strip casting method, the surface roughness, as represented by 10-point average roughness (Rz), of the cast surface of a rotating roller for casting is controlled to fall within a range of 3 μm to 60 μm.

Herein, the term "surface roughness" refers to a surface roughness determined under the conditions specified in JIS B 0601 "Surface roughness—Definitions and Designation", and 10-point average roughness (Rz) is defined therein. Specifically, a surface to be measured is cut with a plane which is perpendicular thereto, to thereby obtain a contour appearing on a cut end (profile curve). Any surface waviness component longer than a prescribed wavelength is cut off from the profile curve by means of a phase-compensation-type high-pass filter or a similar device, to thereby obtain a curve (roughness curve). Only the reference length is sampled from the roughness curve in the direction of its mean line, and the sum of the average value of absolute values of the heights of the five highest profile peaks (Yp) and the depths of the five deepest profile valleys (Yv) measured in the vertical direction from the mean line of this sampled portion is calculated, to thereby obtain the 10-point average roughness (Rz). Measurement parameters such as reference length are defined in the above JIS B 0601, as standard values of reference length for determining corresponding surface roughness values.

Since the surface roughness often varies in a wide range among samples to be measured, an average value of surface roughness for at least five flakes should be employed.

(43) Morphology of Surface Irregularity of the Cast Surface of a Roller

According to the Fourth Aspect of the present invention, surface irregularities are generally provided by a plurality of elongated raised/dented segments formed on the cast surface, almost all of elongated raised/dented segments being formed while extending in a direction forming at least a specific angle to a rotation direction of the roller for casting. Specifically, 30% or more of raised/dented segments extend in a direction forming an angle of 30° or more to a roller rotation direction. Preferably, 30% or more of raised/dented segments extend in a direction forming an angle of 45° or more to a roller rotation direction, or 50% or more of raised/dented segments among entire elongated raised/dented segments extend in a direction forming an angle of 30° or more to a roller rotation direction. More preferably, 50% or more of raised/dented segments among entire elongated raised/dented segments extend in a direction forming an angle of 45° or more to a roller rotation direction.

In case elongated raised/dented segments extend in a rotation direction in parallel, or almost in parallel, when the molten alloy is contacted with the surface of the rotating roller, thereby to fill the space between raised/dented segments, an atmospheric gas in the dented portion is likely to be extruded. As a result, the contact area between the surface of the roller and the molten alloy increases. However, as the angle between the extending direction of raised/dented segments and the rotation direction increases, an atmospheric gas in the dented portion of the surface of the rotating roller tends to be trapped with the molten alloy, thus making it possible to suppress excess contact between the surface of the roller and the molten alloy. Therefore, even though the surface roughness of the cast surface is the same, as the angle between the extending direction of elongated raised/dented segments and the roll rotating direction increases or as the number of elongated raised/dented segments extending in a direction forming a large angle to the roller rotation direction, the formation of the fine R-rich phase region tends to be suppressed. Also the continuity of the internal microstructure along the extending direction of raised/dented segments is lowered as compared with the case wherein the rotation direction corresponds to the extending direction of raised/dented segments. Therefore, if a fine R-rich phase region is formed, there arises the risk of growth of the fine R-rich phase region.

A plurality of elongated raised/dented segments formed on the cast surface can exert the effect of suppressing the above-described fine R-rich phase region when 30% or more of them extend in a direction forming an angle of 30° or more to a roller rotation direction. No effect is exerted when the proportion is 30% or less.

It is not necessarily that elongated raised/dented segments on the surface of the rotating roller for casting of the present invention are continuous, and may be intermittent. Also elongated raised/dented segments may in the form of curve or straight line.

These elongated raised/dented segments can be formed by forming an angle between the polishing direction and a rotation direction even when using an apparatus equipped with a rotating abrasive paper, a rotary wire brush, or a belt abrasive apparatus equipped with an abrasive paper which linearly transfers.

According to the Fourth Aspect of the present invention, uniform microstructure can be provided through effect of elongated raised/dented segments extending in an direction forming an angle to a rotation direction of a roller for casting, even though the surface roughness is comparatively small.

However, when the surface roughness is 3 μm or less, effect exerted by the presence of irregularities of the surface of a rotating roller for casting is unsatisfactory. Thus, heat transfer is promoted through increased contact between the molten alloy and the surface of a rotating roller for casting, thereby readily forming fine R-rich phase region in the alloy.

When the surface roughness of the rotating roller for casting is in excess of 60 μm, a solidified alloy flake is engaged with the roller surface and difficult to peel from the roller, thereby possibly causing trouble such as breakage of a tundish. Therefore, the surface roughness of the rotating roller for casting is controlled to 60 μm or less.

(44) Percent Volume of Fine R-Rich Phase Region in the Alloy

In case an R-T-B alloy is produced by the method of the present invention, the percent volume of fine R-rich phase region in the R-T-B alloy is regulated to 20% or less. Thus, the alloy powder which has been micro-pulverized for producing sintered magnets has a sharp particle size distribution profile, thereby yielding sintered magnets without variation in characteristics.

(45) Method for Producing Rare Earth Sintered Magnet Alloy Powder and Method for Producing Rare Earth Sintered Magnets The rare earth magnet alloy flakes formed of R-T-B alloy for producing a magnet which flakes have been cast through the method according to the present invention are pulverized, shaped, and sintered, to thereby produce anisotropic sintered magnets of excellent characteristics.

Typically, pulverization of the alloy flakes is sequentially performed in the order of hydrogen decrepitation and micro-pulverization, to thereby produce an alloy powder having a size of approximately 3 μm (FSSS).

In the present invention, hydrogen decrepitation includes a hydrogen absorption step as a first step and a hydrogen desorption step as a second step. In the hydrogen absorption step, hydrogen is caused to be absorbed predominantly in the R-rich phase of alloy flakes in a hydrogen gas atmosphere at 266 hPa to 0.3 MPa. The R-rich phase is expanded in volume due to R hydride generated in this step, to thereby minutely break the alloy flakes themselves or generate numerous micro-cracks. Hydrogen absorption is carried out within a temperature range of ambient temperature to approximately 600° C. However, in order to increase expansion in volume of R-rich phase so as to effectively reduce the flakes in size, hydrogen absorption is preferably performed under increased hydrogen gas pressure and within a temperature range of ambient temperature to approximately 100° C. The time for hydrogen absorption is preferably one hour or longer. The R hydride formed through the hydrogen absorption step is unstable in the atmosphere and readily oxidized. Thus, the hydrogen-absorbed product is preferably subjected to hydrogen desorption treatment by maintaining the alloy flakes at about 200 to about 600° C. in vacuum of 1.33 hPa or less. Through this treatment, R hydride can be transformed into a product stable in the atmosphere. The time for hydrogen desorption treatment is preferably 30 minutes or longer. If the atmosphere is controlled for preventing oxidation during steps to be carried out after hydrogen absorption to sintering, hydrogen desorption treatment can also be omitted.

The R-T-B alloy flake produced through the strip casting method according to the present invention is characterized in that R-rich phase is uniformly dispersed in the alloy flake. The average inter R-rich phase spacing, which depends on the particle size of the pulverized powder for producing magnets, is preferably 3 μm to 8 μm. During hydrogen decrepitation, cracks are introduced to the alloy flake along or from the R-rich phase therein. Therefore, micro-pulverization of a product which has undergone hydrogen decrepitation attains, to a maximum degree, the effect of the R-rich phase uniformly and finely dispersed in the alloy, thereby effectively producing an alloy powder exhibiting a remarkably sharp particle size distribution profile. When sintered magnets are produced without performing the hydrogen decrepitation step, the produced sintered magnets have poor characteristics (M. Sagawa et al., Proceeding of the 5th international conference on Advanced materials, Beijing, China (1999)).

Micro-pulverization is a step of pulverizing R-T-B alloy flakes for attaining a particle size of approximately 3 μm (FSSS). Among pulverizers for performing the micro-pulverization, a jet mill is most preferred, in view of high productivity and a sharp particle size distribution profile. By use of alloy flakes according to the present invention having a low fine R-rich phase region content, an alloy powder exhibiting a sharp particle size distribution profile can be produced at high efficiency without variation.

Upon micro-pulverization, the atmosphere is controlled to an inert gas atmosphere such as an argon gas atmosphere or nitrogen gas atmosphere. The inert gas may contain oxygen in an amount of 2% by mass or less, preferably 1% by mass or less. The presence of oxygen enhances pulverization efficiency and attains oxygen concentration of the alloy powder produced through pulverization to 1,000 to 10,000 ppm, to thereby appropriately stabilize the alloy powder. In addition, abnormal grain growth during sintering to form magnets can be prevented.

When the alloy powder is molded in a magnetic field, in order to reduce friction between the powder and the inner wall of a mold and to reduce friction generated among powder particles for enhancing orientation, a lubricant such as zinc stearate is preferably added to the powder. The amount of the lubricant to be added is 0.01 to 1% by mass. Although the lubricant may be added before or after micro-pulverization, the lubricant is preferably mixed sufficiently, before molding in magnetic field, in an inert gas atmosphere such as argon gas or nitrogen gas by use of a mixing apparatus such as a V-blender.

The R-T-B alloy powder having a particle size of about 3 μm (FSSS) obtained through micro-pulverization is press-molded in magnetic field by use of a molding apparatus. The mold to be employed is fabricated from a magnetic material and a non-magnetic material in combination in consideration of the orientation of magnetic field in the mold cavity. The pressure at molding is preferably 0.5 to 2 t/cm$^2$, and the magnetic field in the mold cavity during molding is preferably 5 to 20 kOe. The atmosphere during molding is preferably an inert gas atmosphere such as argon gas or nitrogen gas. However, if the powder has been subjected to the aforementioned anti-oxidation treatment, molding can be performed in air.

Molding may be performed through cold isostatic pressing (CIP) or rubber isostatic pressing (RIP) employing a rubber mold. Since the alloy powder is pressed isostatically through CIP or RIP, variation in orientation of magnetization during press-molding is lowered. Thus, the degree of orientation of the produced compact can be increased as compared with that produced by use of a metal mold, and maximum magnetic energy product can be enhanced.

Sintering of the compact is performed at 1,000 to 1,100° C. The atmosphere during sintering is preferably an argon gas atmosphere or a vacuum atmosphere of $1.33\times10^{-2}$ hPa or less. A retention time at the sintering temperature of one hour or longer is preferred. During sintering, prior to reaching the sintering temperature, a lubricant and hydrogen must be removed as completely as possible from a compact to be sintered. The lubricant is removed by maintaining the compact preferably under the conditions: in vacuum of $1.33\times10^{-2}$ hPa or less or under an Ar flow atmosphere at reduced pressure; at 300 to 500° C.; and for 30 minutes or longer. Hydrogen is removed by maintaining the compact preferably under the conditions: in vacuum of $1.33\times10^{-2}$ hPa or less; at 700 to 900° C.; and for 30 minutes or longer.

After completion of sintering, in order to enhance the coercivity of sintered magnet to be produced, the sintered product may be treated at 500 to 650° C. in accordance with needs. An argon gas atmosphere or a vacuum atmosphere is preferred, and a retention time of 30 minutes or longer is preferred.

The rare earth magnet R-T-B alloy flake produced through the method according to the present invention in which formation of fine R-rich region is suppressed can be used suitably for producing bonded magnets as well as sintered magnets. Production of a bonded magnet by use of the rare earth magnet alloy flakes according to the present invention will next be described.

Firstly, the R-T-B alloy flakes of the present invention undergo heat treatment in advance in accordance with needs. The heat treatment is performed in order to remove α-Fe contained in the alloy and to coarsen crystal grains. The production steps of the alloy powder for producing bonded magnets include hydrogenation-disproportionation-desorption-recombination (HDDR) treatment. However, α-Fe present in the alloy cannot be removed in the HDDR treatment step, and remaining α-Fe deteriorates magnetism. Therefore, α-Fe must be removed prior to performing the HDDR treatment.

The alloy powder for producing bonded magnets has a mean particle size of 50 to 300 μm, which is considerably greater than that of the alloy powder for producing sintered magnets. When the bonded magnet alloy flakes undergo HDDR treatment, crystal orientation of recombined crystal grains of sub-micron size coincides with crystal orientation of crystal grains of the starting alloy flakes with a certain range of variance. Thus, when two or more crystal grains having different crystal orientations are contained in each of starting alloy flakes, each particle of the bonded magnet alloy powder produced from such alloy flakes will contain crystal grains having different crystal orientations. Thus, the alloy powder includes regions having great variance in crystal orientation. In such region, the degree of orientation deteriorates, and maximum magnetic energy product of the magnet is low. In order to avoid such deterioration, the crystal grains contained in the alloy flakes preferably have a large grain size. The alloy cast through a rapid-cooling/solidification method (e.g., strip casting) is prone to have a comparatively small crystal grain size. Thus, coarsening of crystal grains through heat treatment is effective for enhancing magnet characteristics.

There are many reports in connection with the method for producing a bonded magnet alloy powder through the HDDR method (e.g., T. Takeshita et al., Proc. 10th Int. Workshop on RE magnets and their application, Kyoto, Vol. 1, P. 551 (1989)). Production of the alloy powder through the HDDR method is performed in the following manner.

When R-T-B alloy flakes serving as raw material are heated in a hydrogen atmosphere, the $R_2T_{14}B$ phase, a magnetic phase, decomposes at about 700° C. to about 850° C., to thereby form three phases; i.e., α-Fe, $RH_2$, and $Fe_2B$. Subsequently, in order to remove hydrogen, the hydrogen atmosphere is replaced by an inert gas atmosphere or a vacuum atmosphere, and the temperature is maintained approximately in the above range. As a result, separated phases are recombined, to thereby form the $R_2T_{14}B$ phase having an approximately sub-micron crystal grain size. Upon the above process, if the composition of the alloy or treatment conditions are appropriately modified, the magnetization-easy axis of each recombined $R_2T_{14}B$ phase (C-axis of $R_2T_{14}B$ phase) is aligned approximately in parallel to the C-axis of $R_2T_{14}B$ phase present in the raw material alloy before decomposition. Thus, there can be produced an anisotropic magnet powder in which the magnetization-easy axis of minute crystal grains is aligned.

The alloy which has undergone HDDR treatment is pulverized to form an alloy powder having a particle size of about 50 to about 300 μm. By use of the alloy powder, a bonded magnet is produced through a process including mixing with resin and press-molding or injection-molding.

Similar to the case of the aforementioned hydrogen decrepitation, fine R-rich phase region is prone to form a micro-powder through HDDR treatment. Characteristics of the magnetic powder obtained through a HDDR method are deteriorated, as the particle size thereof decreases. Thus, the R-T-B alloy of the present invention in which formation of fine R-rich phase is suppressed is suitably used in production a bonded magnet powder including HDDR treatment.

Recently, it has been reported that surface roughness parameters (Sm/Ra and Sm) of the outer surface of a rotating roller for casting employed are regulated within a specific range, to thereby improve uniformity in microstructure of the produced rare earth alloy (Japanese Patent Application Laid-Open (kokai) Nos. 2002-59245 and 9-1296). However, the above regulation is carried out in order to prevent change in microstructure in a direction of strip width and to prevent lowering of cooling rate at strip ends. In addition, the morphology of raised/dented segments which provide a surface roughness is not particularly specified.

In contrast, according to the present invention, change in microstructure on the alloy flake in a thickness direction; i.e., from the roller side to the free surface side is prevented, to thereby attain a uniform microstructure. The uniformity is determined on the basis of by fine R-rich phase region, and a specific range of percent volume thereof is provided. In this point, the present invention is completely different from the above inventions (Japanese Patent Application Laid-Open (kokai) Nos. 2002-59245 and 9-1296).

Japanese Patent Application Laid-Open (kokai) No. 4-28457 proposes to reduce a change in grain size by regulating the roughness Ra of the surface of the roller within a range of 0.05 μm to 1.5 μm. Although the invention in the publication relates to a rapid quenching having a much higher roller speed and the standard for the measurement of the surface roughness is different from that in the present invention, the present inventors have found that Ra of the surface of the roller for casting of the present invention is larger than that of the above invention.

EXAMPLES

Example 41

Neodymium, ferroboron, cobalt, aluminum, copper, and iron were mixed to thereby obtain the following alloy composition: Nd: 31.5% by mass; B: 1.00% by mass; Co: 1.0% by mass; Al: 0.30% by mass; Cu: 0.10% by mass; and a balance of iron. The resulting mixture was melted in an alumina crucible in an argon gas atmosphere (1 atm) by use of a high-frequency induction melting furnace. The resulting molten alloy was cast through strip casting, to thereby prepare alloy flakes. The rotating roller for casting having a diameter of 300 mm and made of pure copper was employed. During casting, the inside of the copper roller was cooled by water. The roller had a cast surface roughness, as represented by 10-point average roughness (Rz), of 4.0 μm. The surface roughness of the cast surface was generally provided by elongated raised/dented segments formed on the cast surface, 50% or more of raised/dented segments extending in a direction forming an angle of 45° or more to a roller rotation direction. The roller was rotated at a peripheral velocity of 1.0 m/s, to thereby produce alloy flakes having a mean thickness of 0.30 mm.

Ten flakes were selected from the resulting alloy flakes and polished in a fixed state. Each flake was observed under a scanning electron microscope (SEM) and a back-scattered electron image (BEI) was captured at a magnification of ×100. Through analysis of the thus-captured photograph by means of an image graphic analyzer, the percent volume of fine R-rich phase region was found to be 3% or less.

Comparative Example 41

The procedure of Example 41 including preparing a raw material, melting, and casting through an SC method was repeated, except that a rotating roller for casting having a surface roughness, as represented by 10-point average roughness (Rz), of 4.0 μm was employed. The roller has, on the cast surface, elongated raised/dented segments which extend in a rotation direction almost in parallel, and has no substantial segments which incline to the rotation direction.

The thus-produced alloy flakes were evaluated in a manner similar to that of Example 1. The alloy flakes have a percent volume of fine R-rich phase region of 25%.

Comparative Example 42

The procedure of Example 41 including preparing a raw material, melting, and casting through an SC method was repeated, except that a rotating roller for casting having a surface roughness, as represented by 10-point average roughness (Rz), of 100 μm was employed. Similar to the case of Example 1, the surface roughness was generally provided by elongated raised/dented segments formed on the cast surface, 50% or more of raised/dented segments extending in a direction forming an angle of 45° or more to a roller rotation direction.

In Comparative Example 42, a portion of metal remained in contact with the roller, without coming off the roller, and reached the tundish after one rotation of the roller. Since the front end of the tundish was broken by the alloy, casting operation was stopped.

Working examples of production of sintered magnets will next be described.

Example 42

The alloy flakes produced in Example 41 were subjected to hydrogen decrepitation and micro-pulverization by use of a jet mill. Hydrogen absorption step, the step preceding hydrogen decrepitation, was performed under the conditions: 100% hydrogen atmosphere, 2 atm, and retention time of 1 hour. The temperature of the alloy flakes at the start of hydrogen absorption reaction was 25° C. Hydrogen desorption step, subsequent step, was performed under the conditions: vacuum of 0.133 hPa, 500° C., and retention time of 1 hour. To the resultant powder, zinc stearate powder was added in an amount of 0.07% by mass. The mixture was sufficiently mixed in a 100% nitrogen atmosphere by use of a V-blender, and then micro-pulverized by use of a jet mill in a nitrogen atmosphere incorporated with oxygen (4,000 ppm). The resultant powder was sufficiently mixed again in a 100% nitrogen atmosphere by use of a V-blender. The obtained powder was found to have an oxygen concentration of 2,500 ppm. Through analysis of the carbon concentration of the powder, the zinc stearate content of the powder was calculated to be 0.05% by mass. The mean particle sizes of the powder, as measured by means of a laser diffraction particle size distribution measurement apparatus, were found to be 5.11 μm (D50), 1.90 μm (D10), and 8.60 μm (D90).

Subsequently, the thus-obtained powder was press-molded in a 100% nitrogen atmosphere and a lateral magnetic field by use of a molding apparatus. The molding pressure was 1.2 t/cm$^2$, and the magnetic field in the mold cavity was controlled to 15 kOe. The thus-obtained compact was maintained sequentially in vacuum of $1.33\times10^{-5}$ hPa at 500° C. for one hour, in vacuum of $1.33\times10^{-5}$ hPa at 800° C. for two hours, and in vacuum of $1.33\times10^{-5}$ hPa at 1,050° C. for two hours for sintering. The density of the sintered product was as sufficiently high as 7.5 g/cm$^3$ or more. The sintered product was further heat-treated at 560° C. for one hour in an argon atmosphere, to thereby produce a sintered magnet.

Magnet characteristics of the sintered magnet were measured by means of a direct-current BH curve tracer. The results are shown in Table 4. The oxygen content and particle size of the raw micro-powder for producing the sintered magnet are also shown in Table 4.

Comparative Example 43

In a manner similar to Example 42, alloy flakes produced in Comparative Example 41 were pulverized, to thereby obtain a micro-powder. The procedure of molding and sintering performed in Example 2 was repeated, to thereby produce a sintered magnet.

Magnet characteristics of the sintered magnet produced in Comparative Example 43 were measured by means of a direct-current BH curve tracer. The results are shown in Table 4. The oxygen content and particle size of the raw micro-powder for producing the sintered magnet of Comparative Example 43 are also shown in Table 4.

TABLE 4

| | Micro-powder | | | | Magnet | | |
|---|---|---|---|---|---|---|---|
| | Oxygen content | Particle size (μm) | | | Br | iHc | $(BH)_{max}$ |
| | (ppm) | D10 | D50 | D90 | (kG) | (kOe) | (MGOe) |
| Example 42 | 2,500 | 1.9 | 5.1 | 8.6 | 13.6 | 14.5 | 44.4 |
| Comp. Ex. 43 | 3,000 | 1.6 | 5.0 | 8.8 | 13.5 | 13.8 | 43.5 |
| Example 43 | — | — | — | — | 9.1 | 13.5 | 18.0 |
| Comp. Ex. 44 | — | — | — | — | 9.1 | 12.7 | 17.3 |

As is clear from Table 4, a micro-powder obtained in Comparative Example 43 has a smaller D10 as compared with that of the micro-powder obtained in Example 42; i.e., contains large amounts of very minute particles having a particle size of less than about 1 μm. Since such a minute powder is readily oxidized, the micro-powder obtained in Comparative Example 43 exhibits a slightly higher oxygen content as compared with that of the micro-powder of Example 42. Magnetic characteristics of the micro-powder obtained in Comparative Example 43 are inferior to those of the micro-powder of Example 42. The poor characteristics are mainly considered to be attributed to an increase in oxygen content and poor uniformity in microcrystal structure.

Working examples of production of bonded magnets will next be described.

Example 43

The procedure of Example 41 including casting through an SC method was repeated, except that a raw material having the following alloy composition: Nd: 28.5%; B: 1.00% by mass; Co: 10.0% by mass; Ga: 0.5% by mass; and a balance of iron was used, to thereby produce alloy flakes.

The thus-produced alloy flakes were evaluated in a manner similar to that of Example 41. The alloy flakes were found to have a percent volume of fine R-rich phase region of 3% or less. The alloy flakes contain no α-Fe.

The above alloy flakes were subjected to HDDR treatment including annealing under hydrogen (1 atm) at 820° C. for one hour and subsequent annealing in vacuum at 820° C. for one hour. The resultant alloy powder was pulverized by means of a Brawn mill so as to have a particle size of 150 μm or less and blended with an epoxy resin (2.5% by mass). The resultant mixture was press-formed in a magnetic field of 1.5 T, to thereby obtain a bonded magnet. Magnetic characteristics of the bonded magnet are shown in Table 4.

Comparative Example 44

The procedure of Comparative Example 41 including melting and casting through an SC method was repeated, except that the raw material was replaced by the raw material employed in Example 3, to thereby produce alloy flakes. The thus-produced alloy flakes were evaluated in a manner similar to that of Example 41. The alloy flakes were found to have a percent volume of fine R-rich phase region of 30%.

Subsequently, a bonded magnet was produced by use of alloy flakes obtained in Comparative Example 44 in a manner similar to that of Example 43. Magnetic characteristics of the bonded magnet are shown in Table 4.

As is clear from Table 4, the bonded magnet produced in Example 43 exhibits more excellent magnetic characteristics than those of the bonded magnet produced in Comparative Example 44. The bonded magnet produced in Comparative Example 44 has a high percent volume of fine R-rich phase region and contains a large number of comparatively small grains having a grain size of 50 μm or less produced through HDDR treatment or pulverization. The poor magnetic characteristics are considered to be attributable to such a small grain size.

Consequently, according to the method for producing a rare-earth-containing alloy flake of the present invention, there can be produced a rare-earth-containing alloy flake having a small percent volume of fine R-rich region, exhibit higher uniformity in R-rich phase dispersion state in the alloy as compared with alloy flakes produced through a conventional SC method. Thus, sintered magnets produced from the resulting rare-earth-containing alloy flake and bonded magnets produced by use of the flakes through an HDDR method exhibit more excellent magnetic characteristics than those of conventional magnets.

INDUSTRIAL APPLICABILITY

The present invention relates to an improvement of the magnetic properties of rare earth magnets, which are used for various magnetic mediums such as hard discs, MRI (Magnetic resonance Imaging), and motors. The improvement relates to the composition of the rare earth magnet, method of producing the flakes used for the material of the magnets, and methods of fabricating the solid magnets.

The invention claimed is:

1. A main phase alloy for a rare earth magnet to be processed through a two-alloy-blending method, the main phase alloy containing R (R represents at least one rare earth element including Y) in an amount of 26 to 30% by mass and B in an amount of 0.9 to 1.1% by mass, with the balance being T (T represents transition metals including Fe as an essential element), characterized in that R has a Pr content of at least 5% by mass and the main phase alloy has a percent volume of region containing α-Fe on the basis of the entire microstructure of 5% or less, and wherein at least one surface thereof has a surface roughness, as represented by 10-point average roughness (Rz), falling within a range of 5 μm to 50 μm.

2. A main phase alloy for a rare earth magnet according to claim 1, wherein R has a Pr content of at least 15% by mass.

3. A main phase alloy for a rare earth magnet according to claim 2, wherein R has a Pr content of at least 30% by mass.

4. A main phase alloy for a rare earth magnet according to claim 1, wherein at least one surface thereof has a surface roughness, as represented by 10-point average roughness (Rz), falling within a range of 7 μm to 25 μm.

5. A method for producing a main phase alloy for a rare earth magnet according to claim 1, wherein the method comprises strip casting.

6. A method for producing a main phase alloy for a rare earth magnet according to claim 5, wherein the surface roughness, as represented by 10-point average roughness (Rz), of the cast surface of a rotating roller for casting is adjusted to fall within a range of 5 μm to 100 μm.

7. A method for producing a main phase alloy for a rare earth magnet according to claim 5, wherein the surface roughness, as represented by 10-point average roughness (Rz), of the cast surface of a rotating roller for casting is adjusted to fall within a range of 10 μm to 50 μm.

8. A method for producing a main phase alloy for a rare earth magnet to be processed through a two-alloy-blending method, the main phase alloy containing R (R represents at least one rare earth element including Y) in an amount of 26 to 30% by mass and B in an amount of 0.9 to 1.1% by mass, with the balance being T (T represents transition metals including Fe as an essential element), wherein R has a Pr content of at least 5% by mass and the main phase alloy has a percent volume of region containing α-Fe on the basis of the entire microstructure of 5% or less, and wherein at least one surface thereof has a surface roughness, as represented by 10-point average roughness (Rz), falling within a range of 5 μm to 50 μm, the process comprising a centrifugal casting method including depositing and solidifying a molten metal on an inner surface of a cylindrical mold which is rotating.

9. A mixed powder for a rare earth sintered magnet produced by mixing a main phase alloy for a rare earth magnet according to any one of claims 1 to 3 with a boundary phase alloy which has an R content higher than that of the main phase alloy and has a Pr content of R lower than that of the main phase alloy.

10. A mixed powder for a rare earth sintered magnet according to claim 9, wherein the boundary phase alloy contains substantially no Pr.

11. A rare earth sintered magnet produced through a powder metallurgical method making use of a mixed powder for a rare earth magnet according to claim 9.

* * * * *